US005583472A

United States Patent [19]

Moritsu et al.

[11] Patent Number: 5,583,472

[45] Date of Patent: Dec. 10, 1996

[54] SUPERCONDUCTIVE MAGNET

[75] Inventors: Kazuki Moritsu; Takahiro Matsumoto; Shuichi Nakagawa; Shuji Ando, all of Ako; Mitsuhiro Kishida, Tokyo; Hideto Yoshimura, Amagasaki; Masashi Nagao, Amagasaki; Takashi Inaguchi, Amagasaki, all of Japan

[73] Assignee: Mitsubishi Denki Kabushiki Kaisha, Tokyo, Japan

[21] Appl. No.: 387,366

[22] Filed: Feb. 13, 1995

Related U.S. Application Data

[63] Continuation of Ser. No. 99,152, Jul. 29, 1993.

[30] Foreign Application Priority Data

Jul. 30, 1992 [JP] Japan ..... 4-203726

[51] Int. Cl.[6] ..... H01F 1/00; F25B 19/00

[52] U.S. Cl. ..... 335/216; 62/51.1

[58] Field of Search ..... 62/51.1; 335/216; 220/901; 138/149

[56] References Cited

U.S. PATENT DOCUMENTS

| | | | |
|---|---|---|---|
| 967,360 | 8/1910 | Funke | 138/149 |
| 4,266,184 | 5/1981 | Devine | 324/54 |
| 4,516,404 | 5/1985 | Laskaris | 62/45 |
| 4,522,034 | 6/1985 | Laskaris | 62/45 |
| 4,535,596 | 8/1985 | Laskaris | 62/45 |
| 5,034,713 | 7/1991 | Herd | 335/216 |
| 5,176,003 | 1/1993 | Horikawa | 62/51.1 |
| 5,235,818 | 8/1993 | Horikawa | 62/51.1 |

FOREIGN PATENT DOCUMENTS

| | | | |
|---|---|---|---|
| 4129547 | 3/1992 | Germany | 62/51.1 |
| 1-59909 | 3/1989 | Japan | 62/51.1 |
| 1-183104 | 7/1989 | Japan . | |

*Primary Examiner*—Leo P. Picard
*Assistant Examiner*—Stephen T. Ryan
*Attorney, Agent, or Firm*—Wolf, Greenfield & Sacks, P.C.

[57] ABSTRACT

An object of the present invention is to obtain a superconductive magnet, the size of which can be reduced by shortening the radial length of a magnetic device thereof and the refrigerating performance of which can be improved. A cylinder for fastening a refrigerator has an end facing an ambience of helium gas evaporating in a helium chamber and another end which is substantially horizontally fastened to a vacuum chamber. Further, the three-stage regenerative refrigerator is inserted and fastened to the cylinder for fastening the refrigerator. A heat insulator, such as a convection prevention tube, made of a hollow Teflon tube is wound around the outer surface of each stage of the cylinder of the three-stage regenerative refrigerator. The convection prevention tube is enclosed into a gap between the cylinder for fastening the refrigerator and the three-stage regenerative refrigerator without no undesirable gap so that heat convection of the helium gas is prevented.

15 Claims, 22 Drawing Sheets

SUPERCONDUCTIVE MAGNET

This application is a continuation of application Ser. No. 08/099,152, filed Jul. 29, 1993.

BACKGROUND OF THE INVENTION

1. Field of the Invention:

The present invention relates to a superconductive magnet having a very low temperature refrigerator, and more particularly to the structure of a superconductive magnet which is capable of improving the cooling performance and the size of which can be reduced.

2. Description of the Related Art:

FIG. 19 is a cross sectional view which illustrates an example of a conventional superconductive magnet. Referring to FIG. 19, reference numeral 1 represents a superconductive coil. The superconductive coil 1 is immersed in liquid helium 3 enclosed in a helium chamber 2 serving as a very low temperature refrigerant chamber, the liquid helium 3 serving as a very low temperature refrigerant. As a result, the superconductive coil 1 is maintained at a very low temperature. Reference numeral 4 represents a vacuum chamber disposed to surround the helium chamber 2. A space between the vacuum chamber 4 and the helium chamber 2 is evacuated so that the two chambers 4 and 2 are thermally insulated.

Reference numeral 5 represents a second heat shield and 6 represents a first heat shield, the first and second heat shields 5 and 6 being so disposed between the helium chamber 2 and the vacuum chamber 4 to form coaxial cylinder shapes surrounding the helium chamber 2. As a result, heat invasion into the helium chamber 2 is reduced.

Reference numeral 7 represents a liquid nitrogen container formed in a portion of the first heat shield 6, the liquid nitrogen container 7 accommodating liquid nitrogen 8.

Reference numeral 9 represents, for example, a Gifford-MacMahon's two-stage refrigerator comprising a first heat stage 10 set to an absolute temperature of 80 K (Kelvin), a second heat stage 11 set to 20 K and a motor portion 12. The refrigerator 9 is, in the axial direction of the magnet, disposed downwards from an upper portion, the refrigerator 9 being so constituted that the first and second heat stages 10 and 11 respectively cool the first and second heat shields 6 and 5.

Reference numeral 13 represents a port portion disposed for the purpose of injecting the liquid helium 3 and inserting an electric-current lead for supplying electric current to the superconductive coil 1. Reference numeral 14 represents a cold bore.

The operation of the foregoing superconductive magnet will now be described.

The first heat shield 6 is cooled to 80 K by the liquid nitrogen 8 accommodated in the liquid nitrogen container 7 and the first heat stage 10 of the refrigerator 9. The second heat shield 5 is cooled to 20 K by the second heat stage 11 of the refrigerator 9. The invasion heat from outside is insulated in vacuum by the vacuum chamber 4 and shielded by the first and second heat shields 6 and 5 so that the heat invasion into the helium chamber 2 is reduced.

The superconductive coil 1 is cooled to a very low temperature (for example, 4.2 K) by the liquid helium 3 in the helium chamber 2 so that its superconductive state is maintained. When an exciting electric current is, in the foregoing state, supplied from an external power source (omitted from illustration) to the superconductive magnet via the electric current lead (omitted from illustration), a desired magnetic field is generated.

However, the fact that the foregoing conventional superconductive magnet is a hollow magnet facing sideways and the refrigerator 9 is vertically disposed from an upper portion in the axial direction of the magnet necessitates the length for which a piston, called a "displacer", reciprocates to be maintained in order to achieve the cooling performance of the refrigerator 9. Therefore, a large gap must be maintained between the first heat shield 6 and the second heat shield 5 and another large gap must be maintained between the vacuum chamber 4 and the first heat shield 6. As a result, the height of the apparatus cannot be shortened and the size of the same cannot be reduced.

Therefore, an applicant of the present invention has disclosed a superconductive magnet directed to overcome the foregoing problem and arranged such that a very low temperature refrigerator is disposed substantially horizontally and helium gas evaporated in the helium chamber is reliquefied (refer to Japanese Patent Publication No. 4-70922).

FIG. 20 is a partially broken away perspective view which illustrates the conventional superconductive magnet disclosed in Japanese Patent Publication No. 4-70922. Referring to FIG. 20, reference numeral 30 represents a three-stage regenerative type refrigerator disposed on the end surface of a vacuum chamber 4 in substantially parallel to the axial direction of a cylindrical superconductive coil 1. Reference numeral 31 represents an iron magnetic shied disposed to, together with an iron magnetic shield flange 32, surround the vacuum chamber 4. Reference numeral 33 represents a bore, 34 represents a discharge valve fastened to a port portion 13, 35 represents a fastening leg for the superconductive magnet and 36 represents a pressure controller unit for controlling the pressure in a helium chamber 2.

The superconductive magnet is formed into a hollow magnet facing sideways by coaxially disposing the helium chamber 2 for accommodating the superconductive coil 1, a second heat shield 5, a first heat shield 6 and a vacuum chamber 4.

The three-stage regenerative refrigerator 30 for use in the conventional superconductive magnet will now be described with reference to FIG. 21.

The three-stage regenerative refrigerator 30 is so arranged that a first displacer 16, a second displacer 17 and a third displacer 41 are slidably disposed in a cylinder 40 made of, for example, honing pipes and formed into three stages. Further, a first seal 18, a second seal 19 and a third seal 42 for preventing leakage of helium gas 24 are respectively disposed between the cylinder 40 and first, second and third displacers 16, 17 and 41. In addition, a first heat stage 10, a second heat stage 11 and a third heat stage 43 are disposed on the outer surfaces of corresponding stages of the cylinder 40.

A third regenerator 45 in the third displacer 41 is composed of a high-temperature portion **45*a* using GdRh exhibiting a large specific heat at 20 K to 7.4 K as a regenerating material and a low temperature portion 45*b*** using Gd0.5Er0.5Rh exhibiting a large specific heat at temperature lower than 7.5 K as a regenerating material.

The three-stage regenerative refrigerator 30 is operated as follows:

First, high pressure helium gas 24 compressed by a helium compressor 25 serving as a helium gas compression means is introduced into first, second and the third expansion chambers 22, 23 and 46 in a state where the first, second and the third displacer 16, 17 and 41 are at the lowermost positions, a suction valve 26 is opened and an exhaust valve 27 is closed so that a high pressure state is realized.

Then, the first, second and the third displacers 16, 17 and 41 are moved upwards, and the high-pressure helium gas 24 is passed through the first, second and the third regenerators 20, 21 and 45 and introduced into the first, second and third expansion chambers 22, 23 and 46. During the foregoing process, the suction and exhaust valves 26 and 27 are not operated. The high-pressure helium gas 24 is cooled to a predetermined temperature by regenerating materials in the first regenerator 22, the second regenerator 23 and the third regenerator 45 when the helium gas 24 is passed through the foregoing regenerators 22, 23 and 45.

When the first, second and the third displacers 16, 17 and 41 are moved to the uppermost positions, the suction valve 26 is closed and the exhaust valve 27 is opened so that the high-pressure helium gas 24 is expanded in the low-pressure portion and refrigeration is generated. At this time, the helium gas 24 is formed into a low-temperature and low-pressure gas.

The ensuing downward movements of the first, second and the third displacers 16, 17 and 41 cause the low-temperature and low-pressure helium gas 24 to be passed through the first, second and the third regenerators 20, 21 and 45 before it is exhausted from the exhaust valve 27. The low-temperature and low-pressure helium gas 24, at this time, cools the regenerating materials in the first, second and the third regenerators 20, 21 and 45 before it is returned to the helium compressor 25.

In an ensuing state where the capacities of the first, second and third expansion chambers 22, 23 and 36 have been minimized, the exhaust valve 27 is closed and the suction valve 26 is opened. As a result, the high pressure helium gas 24 compressed by the helium compressor 26 is introduced so that the pressures in the first, second and the third expansion chambers 22, 23 and 46 are lowered from the high pressures.

The high pressure, for example, 20 bars-helium gas 24 is cooled to 60 K by the first regenerator 20, cooled to 15 K by the second regenerator 21 and cooled by the third regenerator 45 before it is introduced into the third expansion chamber 46.

If the regenerating material in the third regenerator 45 is lead, its specific heat is smaller than that of the helium gas 24. Therefore, the helium gas 24 is not cooled sufficiently but it is introduced into the third expansion chamber 46. As a result, the temperature of the expansion chamber is raised, resulting in a loss to be generated. In this case, an unsatisfactory temperature level of about 6.5 K can be realized. If GdRh is used as the regenerating material, its specific heat is larger than that of lead. Therefore, the loss can be restricted and, accordingly, a satisfactory temperature level of 5.5 K can be realized.

If the regenerating material comprises GdRh and Gd0.5Er0.5Rh (the weight ratio of GdRh is made to be 45 to 65%), a temperature level of 4.2 K can be realized. When the surface roughness of the inner surface of the cylinder 40 was made to be 0.5 μm RMS to reduce the leakage through the sealed portion, a temperature level of 3.68 K was realized.

When Er3Ni was used as the regenerating material in place of GdRh, a similar temperature level was realized.

It should be noted that the "high pressure" for the helium gas 24 was set to 20 bars and the "low pressure" was set to 6 bars.

Since the three-stage regenerative refrigerator 30 is constituted by the first regenerator 20 using the copper net as the regenerating material, the second regenerator 21 using lead balls as the regenerating material, the third regenerator 45 composed of a high temperature portion **45*a* using GdRh as the regenerating material and a low temperature portion 45*b* using Gd0.5Er0.5Rh as the regenerating material, excellent refrigerating performance can be obtained such that the first heat stage 10 realizes 50 to 80 k, the second heat stage 11 realizes 10 to 20 K and the third heat stage 43** realizes 2 to 4.5 K. Therefore, the superconductive magnet can be operated stably.

FIG. 22 illustrates the fastened state of the structure of the three-stage regenerative refrigerator 30. An L-shape pipe 50 made of stainless steel and serving as an outlet portion is so fastened to the upper portion of the helium chamber 2 that an end of the L-shape pipe 50 faces the helium gas atmosphere evaporating in the helium chamber 2. Further, a three-stage cylinder 51 for fastening the refrigerator 30 and made of stainless steel is fastened to the end surface of the vacuum chamber 4, the cylinder 51 for fastening the refrigerator 30 being fastened substantially in parallel to the axial direction of the superconductive coil 1. The L-shape pipe 50 and the cylinder 51 for fastening the refrigerator 30 are connected to each other by bellows 52. The cylinder 51 for fastening the refrigerator 30 has a copper first stage 53 and a second stage 54 which are respectively thermally connected to a first heat shield 6 and a second heat shield 5.

The three-stage regenerative refrigerator 30 is fastened as follows: the third heat stage 43 is so inserted into the cylinder 51 for fastening the refrigerator 30 that the third heat stage 43 is exposed to the helium gas atmosphere received into the L-shape pipe 50; and the first heat stage 10 and the second heat stage 11 are thermally connected to the cylinder 51 for fastening the refrigerator 30.

Since the cylinder 51 for fastening the refrigerator 30 is fastened at the end surface of the vacuum chamber 4 to substantially run parallel to the axial direction of the superconductive coil 1 as described above, the reciprocative movement distance for each displacer contributing to the refrigerating performance of the three-stage regenerative refrigerator 30 can be maintained while eliminating necessities of enlarging the gaps among the helium chamber 2, the second heat shield 5, the first heat shield 6 and the vacuum chamber 4. As a result, the size of the superconductive magnet can be reduced. Further, the arrangement that the three-stage regenerative refrigerator 30 is detachably fastened to the cylinder 51 for fastening the refrigerator 30 enables the three-stage regenerative refrigerator 30 to be removed without decomposing the apparatus. As a result, the maintenance facility can be improved.

FIG. 23 illustrates the thermal connections established among the cylinder 51 for fastening the refrigerator 30, the first heat shield 6 and the second heat shield 5. The second heat shield 5 has a second cut portion 60 formed therein. Further, the first heat shield 6 has a first cut portion 61 so arranged that the second cut portion 60 appears. In addition, the vacuum chamber 4 has a cut portion 62 so arranged that the first cut portion 61 appears.

By establishing connections between the first stage 53 and the first heat shield 6 and between the second stage 54 and the second heat shield 5 by making use of flexible conductors 63 each of which is manufactured by, for example, knitting copper wires, the first stage 53 and the first heat shield 6 are thermally connected to each other. Similarly, the second stage 54 and the second heat shield 5 are thermally connected to each other. Further, a second radiation cover 55 and a first radiation cover 56 are disposed to cover the second cut portion 60 and the first cut portion 61, respectively. In addition, a capping plate 57 made of stainless steel is fastened to the vacuum chamber 4 to cap the cut portion 62.

The first stage 53 and the second stage 54 of the cylinder 51 for fastening the refrigerator 30, end portions of which are fastened to the end surface of the vacuum chamber 4 and other end portions of which are fastened to the L-shape pipe 50 while interposing the bellows 52, are structured as to appear in the cut portion 62 and the first cut portion 61. As a result, the first stage 53 and the second stage 54 can easily establish the thermal connections among the cylinder 51 for fastening the refrigerator 30, the first and second heat shields 6 and 5 in such a manner that the connections are not hindered by the first and second heat shields 6 and 5 and the vacuum chamber 4. Further, the arrangement that the first and the second cut portions 61 and 60 are capped by the first and the second radiation covers 56 and 55 reduces the external heat invasion.

FIG. 24 illustrates the connection structure established between the three-stage regenerative refrigerator 30 and the cylinder 51 for fastening the refrigerator 30. The cylinder 51 for fastening the refrigerator 30 has, on the inner surface thereof on which the first stage 53 is fastened, a heat conductor 64 adjacent to the cylinder 51 for fastening the refrigerator 30, the conductor 54 having a tapered surface. The first heat stage 10 of the three-stage regenerative refrigerator 30 has a heat conductor 65 adjacent to the refrigerator 30, the heat conductor 65 having a tapered surface in which knurling is formed to face the tapered surface of the heat conductor 64 adjacent to the cylinder 51 for fastening the refrigerator 30.

Further, the heat conductor 64 adjacent to the cylinder 51 for fastening the refrigerator 30 and the heat conductor 65 adjacent to the refrigerator 30 respectively are disposed on the inner surface of the cylinder 51 for fastening the refrigerator 30, at which the second stage 54 is fastened, and the second heat stage of the third stage regenerative refrigerator 30. The heat conductor 64 adjacent to the cylinder 51 for fastening the refrigerator 30 and the heat conductor 65 adjacent to the refrigerator 30 are made of copper which is excellent heat conductive material.

An indium wire 66, which is soft metal for establishing the thermal connection, is disposed between the heat conductor 64 adjacent to the cylinder 51 for fastening the refrigerator 30 and the heat conductor 65 adjacent to the refrigerator 30. Further, a bolt 69 for fastening a flange 68 of the three-stage regenerative refrigerator 30 is, via a belleville spring 70, which is an elastic member, fastened to a fastening flange 67 of the cylinder 51 for fastening the refrigerator 30. In addition, an "O" ring 71 which is an airtightening sealing member is disposed between the fastening flange 67 and the flange 68.

When the flange 68 is fixed to the fastening flange 67 by making use of the bolt 69, the flange 68 slides while maintaining the airtightness thanks to the "O" ring 71. The fastening force of the bolt 69 plastically deforms the indium wire 66 so that the thermal connection is established between the heat conductor 64 adjacent to the cylinder 51 for fastening the refrigerator 30 and the heat conductor 65 adjacent to the refrigerator 30.

Excessive fastening force of the bolt 69 and the displacements of the elements due to the thermal contraction and vibrations are absorbed by the belleville spring 70 so that the breakage of the elements and the defective thermal connection can be prevented. Further, even if the three-stage regenerative refrigerator 30 is contracted after it has been fastened to the cylinder 51 for fastening the refrigerator 30 and cooled sufficiently, further tightening of the bolt 69 enables a desired fastening force to be maintained.

Further, the tapered surface of the heat conductor 65 adjacent to the refrigerator 30 is knurled so that the fastening force between the indium wire 66 and the knurled surface is enlarged. Therefore, when the three-stage regenerative refrigerator 30 is removed, the removal can be performed such that the indium wire 66, which has been deformed plastically, adheres to the tapered surface of the heat conductor 65 adjacent to the refrigerator 30.

Since the conventional superconductive magnet has the arrangement that the refrigerator 9 is disposed vertically in the axial direction of the magnet as described above, the position of the magnet device cannot be lowered and, accordingly, the overall size cannot be reduced.

Since the superconductive magnet disclosed by the applicant of the present invention has the arrangement that the three-stage regenerative refrigerator 30 is disposed substantially horizontally as to reliquefy the helium gas evaporated in the helium chamber 2, the height of the apparatus can be lowered and therefore the overall size of the apparatus can be reduced. Further, the distance for which the displacer reciprocates can be maintained, causing the refrigerating performance to be improved. However, a gap is formed between the cylinder 51 for fastening the refrigerator 30 and the three-stage regenerative refrigerator 30, the gap being filled with the helium gas received through the L-shape pipe 50 and evaporated in the helium chamber 2. Further, a thermal gradient occurs in each stage of the cylinder 40 of the three-stage regenerative refrigerator 30. The foregoing helium gas is heated in the hot portion in the cylinder 40, cooled in the low temperature portion, and therefore a heat convection is generated. It leads to a fact that the temperature of the first heat stage 10, which is the low temperature portion, is raised. Therefore, there arises a problem in that the cooling performance of the refrigerator deteriorates.

SUMMARY OF THE INVENTION

An object of the present invention is directed to overcome the foregoing problems and therefore an object of the present invention is to provide a superconductive magnet, the overall size of which can be reduced because the radial directional length of a magnetic device thereof is shortened, and the performance of which can be improved and in which helium gas can be reliquefied.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein a string-like heat insulator is wound around the outer surface of the cylinder of the multi-stage regenerative refrigerator.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein a cylindrical and sponge-like heat insulator is fastened to the outer surface of the cylinder of the multi-stage regenerative refrigerator.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein a cylindrical and sponge-like heat insulator having a cover on the outer surface thereof is fastened to the outer surface of the cylinder of the multi-stage regenerative refrigerator.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein a tubular heat insulator having sponge-like heat insulating materials secured to the inner and outer surfaces thereof is fastened to the outer surface of the cylinder of the multi-stage regenerative refrigerator.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein a heat insulator formed by bagging granular heat insulating materials is enclosed between the multi-stage regenerative refrigerator and the cylinder for fastening the refrigerator.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein a partition plate for partitioning a flow of the very low temperature refrigerant gas in the axial direction of the multi-stage regenerative refrigerator is disposed between the multi-stage regenerative refrigerator and the cylinder for fastening the refrigerator.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein a partition plate for partitioning a flow of the very low temperature refrigerant gas in the circumferential direction of the multi-stage regenerative refrigerator is disposed between the multi-stage regenerative refrigerator and the cylinder for fastening the refrigerator.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein a tubular and low-heat-conductive base is fastened to the outer surface of the cylinder of the multi-stage regenerative refrigerator and a sealant for sealing a space from the inner surface of the cylinder for fastening the refrigerator is fastened to the low heat conductive base.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage; and a heat insulator enclosed between the multi-stage regenerative refrigerator and the cylinder for fastening the refrigerator, wherein an inlet port of the cylinder for fastening the refrigerator through which the refrigerator is inserted is formed into a tapered surface.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein an angle for fastening the multi-stage regenerative refrigerator is 10° to 25°.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage; and a heat insulator enclosed between the multi-stage regenerative refrigerator and the cylinder for fastening the refrigerator, wherein the heat insulator is formed into two tubular members sectioned axially.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein the heat stage of the multi-stage regenerative refrigerator is not projected over the outline of the cylinder of the multi-stage regenerative refrigerator.

A superconductive magnet according to the present invention comprises: a superconductive coil; a very low temperature refrigerant chamber for accommodating the superconductive coil and reserving a very low temperature refrigerant for cooling the superconductive coil; a heat shield for surrounding the very low temperature refrigerant chamber; a vacuum chamber for surrounding the heat shield; a cylinder for fastening the refrigerator an end of which faces an ambience of very low temperature refrigerant gas evaporating in the very low temperature refrigerant chamber and another end of which is substantially horizontally fastened to the vacuum chamber; and a multi-stage regenerative refrigerator inserted and secured in the cylinder for fastening the refrigerator and arranged to reliquefy the very low temperature refrigerant gas introduced into the cylinder for fastening the refrigerator in at least a portion of a heat stage, wherein a sub-cylinder having the outer diameter which is substantially the same as the inner diameter of the cylinder for fastening the refrigerator is fastened to the outer surface of the cylinder of the multi-stage regenerative refrigerator while interposing bellows.

Since the superconductive magnet according to the present invention is so arranged that the string-like heat insulator is wound around the outer surface of the cylinder of the multi-stage regenerative refrigerator, the gap between the cylinder of the multi-stage regenerative refrigerator and the cylinder for fastening the refrigerator can be filled with the heat insulator. Therefore, the heat convection of the very low temperature refrigerant can be prevented, heat can efficiently be insulated and the shape and the size can satisfactorily freely be determined. As a result, heat insulation capable of adapting to the clearance between the cylinder of the multi-stage regenerative refrigerator and the cylinder for fastening the refrigerator can easily be realized.

Since the superconductive magnet according to the present invention is so arranged that the heat insulator to be fastened to the outer surface of the cylinder of the multi-stage regenerative refrigerator is formed into a cylindrical and sponge-like heat insulator, the heat insulator can sufficiently be enclosed into the gap between the cylinder of the multi-stage regenerative refrigerator and the cylinder for fastening the refrigerator due to the elasticity of the sponge-like member. As a result, the heat convection of the very low temperature refrigerant can be prevented and heat can efficiently be insulated.

Since the superconductive magnet according to the present invention is so arranged that the Teflon sheet is disposed on the outer surface of the cylindrical and sponge-like heat insulator to be fastened to the outer surface of the cylinder of the multi-stage regenerative refrigerator, the frictional force between the Teflon sheet and the inner surface of the cylinder for fastening the refrigerator can be reduced at the time of inserting the multi-stage regenerative refrigerator into the cylinder for fastening the refrigerator. As a result, the multi-stage regenerative refrigerator can easily be inserted.

Since the superconductive magnet according to the present invention is so arranged that the sponge-like heat insulating materials are secured to the inner and outer surfaces of the tubular heat insulator to be fastened to the outer surface of the cylinder of the multi-stage regenerative refrigerator, the heat insulator can easily be inserted into the multi-stage regenerative refrigerator. Further, it can easily be inserted into the cylinder for fastening the refrigerator.

Since the superconductive magnet according to the present invention is so arranged that the heat insulator to be enclosed between the multi-stage regenerative refrigerator and the cylinder for fastening the refrigerator is formed by bagging granular heat insulating material, the heat insulator can be enclosed while being formed into a shape adaptable to the shape of the gap between the multi-stage regenerative refrigerator and the cylinder for fastening the refrigerator.

Since the superconductive magnet according to the present invention is so arranged that the partition plate for partitioning the flow of the very low temperature refrigerant gas in the axial direction of the multi-stage regenerative refrigerator is disposed between the multi-stage regenerative refrigerator and the cylinder for fastening the refrigerator, the flow of the very low temperature refrigerant gas in the gap between the multi-stage regenerative refrigerator and the cylinder for fastening the refrigerant in the axial direction of the multi-stage regenerative refrigerator can be partitioned and the heat convection can be restricted.

Since the superconductive magnet according to the present invention is so arranged that the partition plate for partitioning the flow of the very low temperature refrigerant gas in the circumferential direction of the multi-stage regenerative refrigerator is disposed between the multi-stage regenerative refrigerator and the cylinder for fastening the refrigerator, the flow of the very low temperature refrigerant gas in the gap between the multi-stage regenerative refrigerator and the cylinder for fastening the refrigerant in the circumferential direction of the multi-stage regenerative refrigerator can be partitioned and the heat convection can be restricted.

Since the superconductive magnet according to the present invention is so arranged that the tubular and low-heat-conductive base is fastened to the outer surface of the cylinder of the multi-stage regenerative refrigerator and a sealant for sealing the space from the inner surface of the cylinder for fastening the refrigerator is fastened to the low-heat-conductive base, the flow of the very low temperature refrigerant gas of the multi-stage regenerative refrigerator in the gap between the multi-stage regenerative refrigerator and the cylinder for fastening the refrigerator can be prevented and the heat convection can be prevented.

Since the superconductive magnet according to the present invention is so arranged that the inlet port of the cylinder for fastening the refrigerator, through which the refrigerator is inserted, is tapered, the heat insulator can easily be inserted in such a manner that it is not caught at the inlet port of the cylinder for fastening the refrigerator through which the refrigerator is inserted. As a result, the heat insulator can easily be inserted and enclosed.

Since the superconductive magnet according to the present invention is so arranged that the angle made by the fastened multi-stage regenerative refrigerator is 10° to 25°, the heat convection of the very low temperature refrigerant gas between the multi-stage regenerative refrigerator and the cylinder for fastening the refrigerator can be prevented.

Since the superconductive magnet according to the present invention is so arranged that the heat insulator is formed into the tube divided into two sections in the axial direction, the heat insulator can easily be fastened to the cylinder of the multi-stage regenerative refrigerator.

Since the superconductive magnet according to the present invention is so arranged that projection of the heat stage of the multi-stage regenerative refrigerator over the outline of the cylinder of the multi-stage regenerative refrigerator is inhibited, the clearance between the cylinder of the multi-stage regenerative refrigerator and the cylinder for fastening the refrigerator can be reduced. Therefore, the heat convection of the very low temperature refrigerant gas can be restricted.

Since the superconductive magnet according to the present invention is so arranged that the sub-cylinder having the outer diameter which is substantially the same as the inner diameter of the cylinder for fastening the refrigerator is, via the bellows, fastened to the outer surface of the cylinder of the multi-stage regenerative refrigerator, the clearance between the cylinder of the multi-stage regenerative refrigerator and the cylinder for fastening the refrigerator can be reduced, the heat convection of the very low temperature refrigerant gas can be restricted and the axial deviation of the multi-stage regenerative refrigerator or the cylinder for fastening the refrigerator can be absorbed by the bellows and fastening can easily be performed.

DESCRIPTION OF THE PREFERRED EMBODIMENTS

Figure 1:
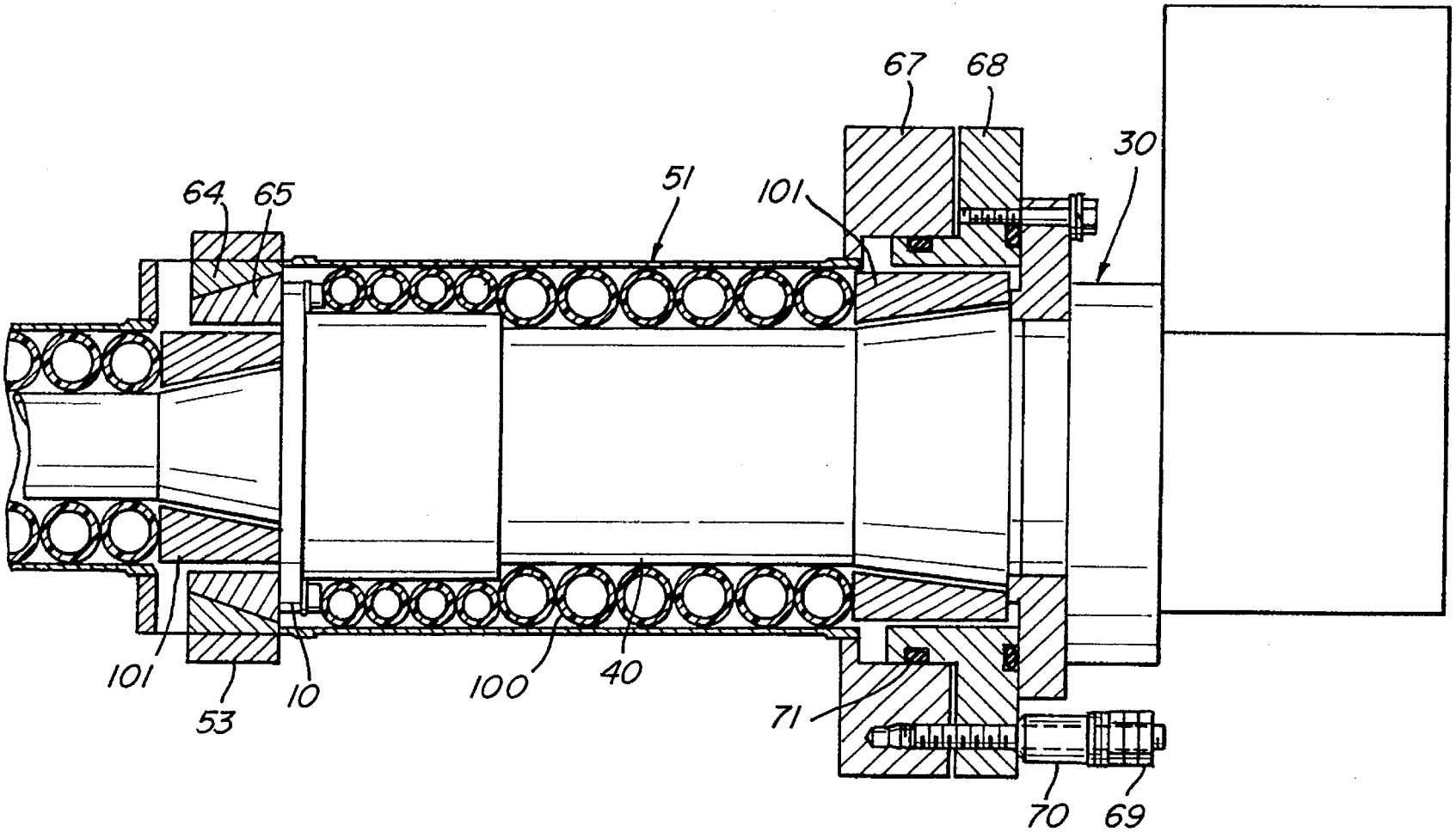
FIG. 1 is a cross sectional view which illustrates the structure of the connection established in the superconductive magnet according to a first embodiment of the present invention between a three-stage regenerative refrigerator and a cylinder for fastening the refrigerator.
Figure 2:
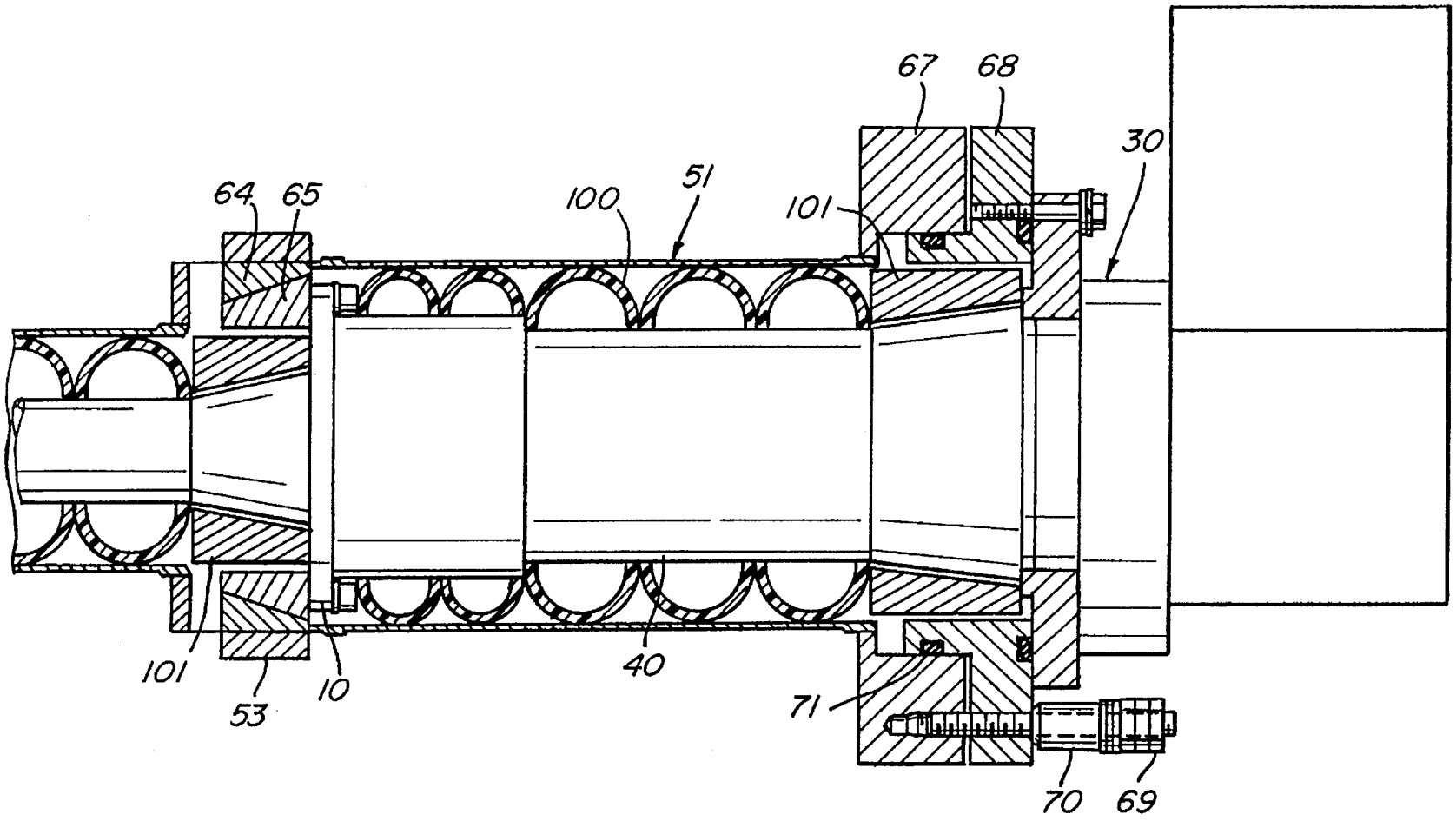
FIG. 2 is a cross sectional view which illustrates the structure of the connection established in the superconductive magnet according to a second embodiment of the present invention between the three-stage regenerative refrigerator and the cylinder for fastening the refrigerator.

The present invention relates to an improvement in the superconductive magnet (Japanese Patent Laid-Open No. 4-70922) previously disclosed by the applicant of the present invention and shown in FIGS. 20 to 24. The same or corresponding elements are given the same reference numerals and their descriptions are omitted here. The description will be made about the characteristic portions of the present invention.

First Embodiment

A first embodiment of the present invention will now be described. FIG. 1 is a cross sectional view which illustrates the structure of the connection employed in a superconductive magnet according to the first embodiment of the present invention, the connection being established between a three-stage regenerative refrigerator and a cylinder for fastening the refrigerator.

Referring to FIG. 1, reference numeral 100 represents a convection prevention tube made of a hollow Teflon tube and serving as a heat insulating member, the convection prevention tube 100 being wound spirally around the outer surface of each stage of a cylinder 40 of a three-stage regenerative refrigerator 30. Reference numeral 101 represents a spacer fastened to the three-stage regenerative refrigerator 30 and arranged to prevent the axial slip of the convection prevention tube 100.

In this embodiment, the convection prevention tube 100 is wound around the outer surface of each of the stages of the cylinder 40 of the three-stage regenerative refrigerator 30. Further, the spacer 101 is fastened, and the three-stage regenerative refrigerator 30 is inserted into a cylinder 51 for fastening the refrigerator 30. Although the convection prevention tube 100 is given axial frictional force from the cylinder 51 for fastening the refrigerator 30 at the time of inserting the three-stage regenerative refrigerator 30, the spacer 101 prevents the axial slip. Since the convection prevention tube 100 is formed into the tubular shape, it is inserted while being deformed elastically so that it is enclosed between the three-stage regenerative refrigerator 30 and the cylinder 51 for fastening the refrigerator 30.

The operation of the first embodiment will now be described. The helium gas evaporated in the helium chamber 2 tends to be introduced into a gap between the three-stage regenerative refrigerator 30 and the cylinder 51 for fastening the refrigerator 30. However, the convection prevention tube 100 enclosed between the three-stage regenerative refrigerator 30 and the cylinder 51 for fastening the refrigerator 30 restricts the invasion of the helium gas.

As described above, the convection prevention tube 100 is wound around the outer surface of the cylinder 40 of the three-stage regenerative refrigerant 30, the convection prevention tube 100 being enclosed in the gap between the three-stage regenerative refrigerator 30 and the cylinder 51 for fastening the refrigerator 30. Therefore, introduction of helium gas into the gap between the three-stage regenerative refrigerator 30 and the cylinder 51 for fastening the refrigerator 30 is restricted so that the heat convection of the helium gas due to the thermal gradient occurring in the cylinder 40 of the three-stage regenerative refrigerator 30 can be prevented. Therefore, heat insulation can effectively be performed and, accordingly, deterioration in the refrigerating performance of the refrigerator can be prevented. Further, the heat insulator can easily be wound, the shape and dimension can freely be determined, and the assembling facility can be improved.

Second Embodiment

A second embodiment is another embodiment of the present invention. Although the first embodiment is so arranged that the convection prevention tube 100 made of the hollow Teflon tube is spirally wound around the outer surface of the cylinder 40 of the three-stage regenerative refrigerator 30, the second embodiment is arranged in such a manner that a convection prevention tube 100 made of a Teflon tube having a circular arc cross sectional shape is wound around the cylinder 40 of the three-stage regenerative refrigerator 30. In this embodiment, a similar effect can be obtained.

Third Embodiment

A third embodiment is another embodiment of the present invention. Although the first and second embodiments are arranged such that the Teflon tube serving as the convection prevention tube 100 in the form of a hollow tube or having a circular arc cross sectional shape is spirally around the outer surface of the cylinder 40 of the three-stage regenerative refrigerator 30, the third embodiment has an arrangement that the convection prevention tube 100 is changed to a Teflon ring having a circular arc cross sectional shape, the Teflon ring being inserted into the cylinder 40 of the three-stage regenerative refrigerator 30 to surround the same. In this embodiment, a similar effect can be obtained.

Fourth Embodiment

Figure 3:
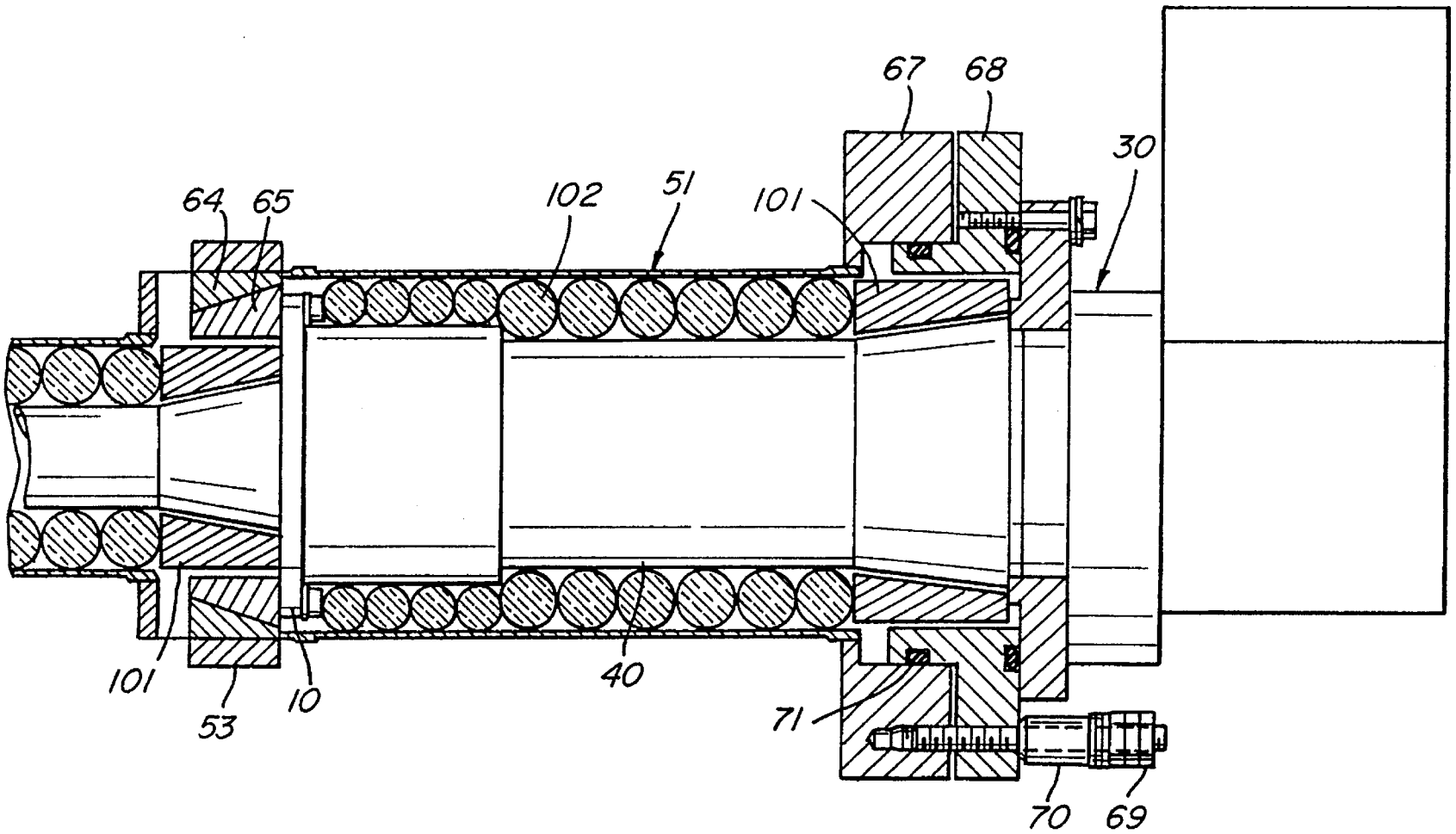
FIG. 3 is a cross sectional view which illustrates the structure of the connection established in the superconductive magnet according to a fourth embodiment of the present invention between the three-stage regenerative refrigerator and the cylinder for fastening the refrigerator.

A fourth embodiment is another embodiment of the present invention. Although the first embodiment is so arranged that the convection prevention tube 100 made of the hollow Teflon tube is spirally wound around the outer surface of the cylinder 40 of the three-stage regenerative refrigerator 30, the fourth embodiment is, as shown in FIG. 3, arranged in such a manner that a string-like convection prevention member 102 formed by knitting glass fiber is wound around the cylinder 40 of the three-stage regenerative refrigerator 30. In this embodiment, a similar effect can be obtained.

Although the first to fourth embodiments use the convection prevention tube 100 or the convection prevention member 102 made of Teflon or glass fiber to serve as the string-like heat insulator, the heat insulator is not limited to the Teflon or the glass fiber, and any low-heat-conductive material, for example, asbestos, may be employed.

Fifth Embodiment

Figure 4:
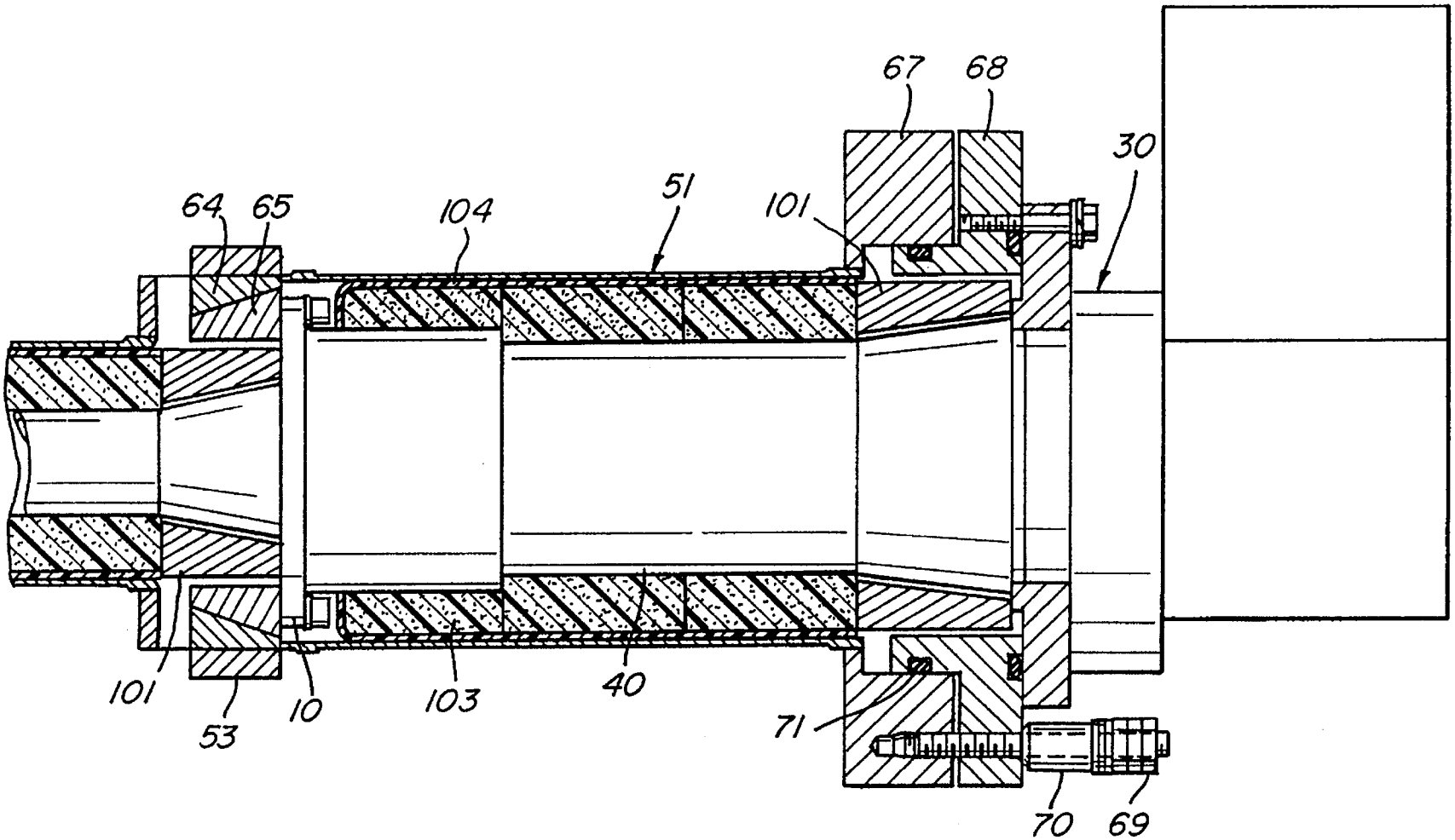
FIG. 4 is a cross sectional view which illustrates the structure of the connection established in the superconductive magnet according to a fifth embodiment of the present invention between the three-stage regenerative refrigerator and the cylinder for fastening the refrigerator.

A fifth embodiment is an embodiment of the present invention. FIG. 4 is a cross sectional view which illustrates an essential portion of the structure of the connection established in a superconductive magnet according to the fifth embodiment of the present invention between a three-stage regenerative refrigerator and a cylinder for fastening the refrigerator.

Referring to FIG. 4, reference numeral 103 represents a sponge-like material serving as the heat insulator, the sponge-like material 103 being made by foaming natural rubber into a cylindrical shape. The sponge-like material 103 is fastened and secured to the outer surface of the cylinder 40 of the three-stage regenerative refrigerator 30. Reference numeral 104 represents a Teflon sheet serving as a cover fastened on to the outer surface of the sponge-like material 103.

The fifth embodiment is arranged in such a manner that the cylindrical and sponge-like material 103 is fastened and secured to the outer surface of each stage of the cylinder 40 of the three-stage regenerative refrigerator 30. Further, the Teflon sheet 104 is disposed on the outer surface of the sponge-like material 103, and then the three-stage regenerative refrigerator 30 is inserted into the cylinder 51 for fastening the refrigerator 30. At this time, the Teflon sheet 104 reduces frictional force which can be generated from the cylinder 51 for fastening the refrigerator 30 at the time of inserting the three-stage regenerative refrigerator 30. Further, the sponge-like material 103 is inserted while being deformed elastically so as to press the Teflon sheet 104 against the inner surface of the cylinder 51 for fastening the refrigerator 30.

As described above, the fifth embodiment is so arranged that the sponge-like material 103 is fastened and secured to the cylinder 40 of the three-stage regenerative refrigerator 30. Therefore, the elastic force of the sponge-like material 103 closes the gap between the three-stage regenerative refrigerator 30 and the cylinder 51 for fastening the refrigerator 30. As a result, the introduction of the helium gas is restricted, the heat convection can be prevented, the thermal insulation can efficiently be performed and deterioration in the refrigerating performance of the refrigerator can be prevented.

Further, the Teflon sheet 104 disposed on the outer surface of the sponge-like material 103 reduces the frictional force, which can be generated from the cylinder 51 for fastening the refrigerator 30 at the time of inserting the three-stage regenerative refrigerator 30, so that the refrigerator 30 can easily be inserted. As a result, the assembling facility can be improved.

Although the fifth embodiment employs the Teflon cover 104 as the cover, the material of the cover is not limited to Teflon if the employed material is a low-heat-conductive material. If a material having a small coefficient of friction is employed, the insertion of the refrigerator can be performed easily.

Sixth Embodiment

Figure 5:
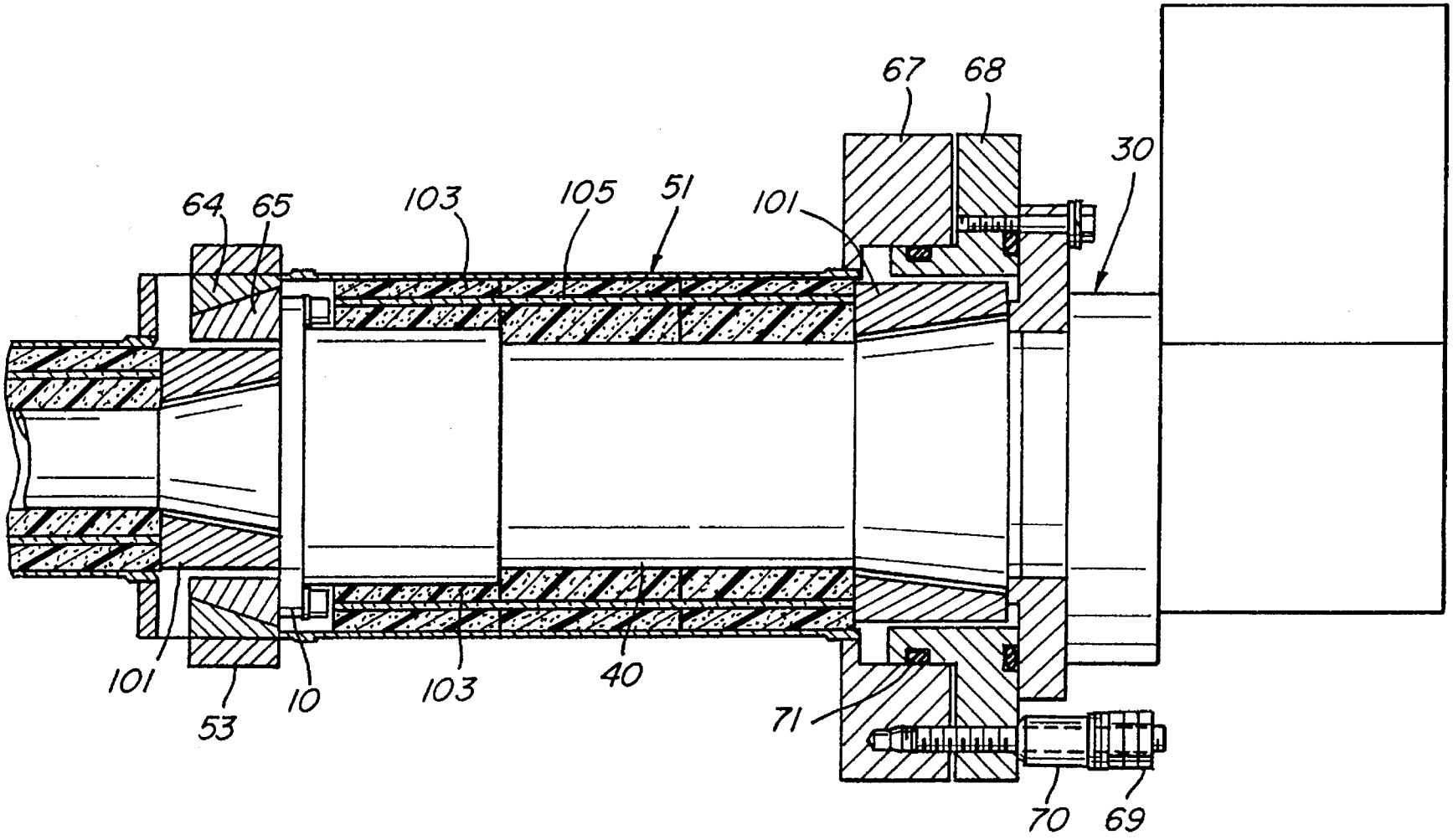
FIG. 5 is a cross sectional view which illustrates the structure of the connection established in the superconductive magnet according to a sixth embodiment of the present invention between the three-stage regenerative refrigerator and the cylinder for fastening the refrigerator.

The sixth embodiment is an embodiment of the present invention. FIG. 5 is a cross sectional view which illustrates an essential portion of the structure of the connection established in a superconductive magnet according to the sixth embodiment of the present invention between the three-stage regenerative refrigerator and the cylinder for fastening the refrigerator.

Referring to FIG. 5, reference numeral 105 represents a quartz glass tube serving as the heat insulator, the quartz glass tube 105 having sponge-like materials 103 on the inner and outer surfaces thereof. The quartz glass tube 103 is inserted and fastened into the cylinder 40 of the three-stage regenerative refrigerator 30.

Since the sixth embodiment is so arranged that the sponge-like materials 103 are secured to the inner and outer surfaces of the quartz glass tube 105, the three-stage regenerative refrigerator 30 can easily be inserted into the cylinder 40. As a result, the assembling facility can be improved. Further, even if the gap between the three-stage regenerative refrigerator 30 and the cylinder 51 for fastening the refrigerator 30 is changed due to the thermal contraction of the cylinder 40 or the like, the sponge-like material 103 covers the gap to prevent the introduction of the helium gas into the gap and the heat convection. As a result, deterioration in the refrigerating performance of the refrigerator can be prevented.

Since the quartz glass tube 105 is made of a material having a low coefficient of thermal expansion, the thermal contraction of the quartz glass tube 105 can be prevented even if it is rapidly cooled from the atmospheric temperature state to a very low temperature state at the time of fastening the quartz glass tube 105 into the cylinder 51 for fastening the refrigerator 30. Therefore, the clearance from the cylinder 51 for fastening the refrigerator 30 can be restricted and, accordingly, the heat convection can further be prevented.

Seventh Embodiment

A seventh embodiment is another embodiment of the present invention. Although the sixth embodiment is arranged so that the sponge-like materials 103 are secured to the inner and outer surfaces of the quartz glass tube 105, the seventh embodiment is arranged in such a manner that the sponge-like materials 103 are secured to the outer surface of the quartz glass tube 105 and that of the cylinder 40. In this case, a similar effect can be obtained.

Although each of the foregoing sixth and seventh embodiments employs the quartz glass tube 105 as the heat insulator, any heat insulator may be employed if it is formed into a tubular shape and made of a low-heat-conductive material having a low coefficient of thermal expansion. For example, epoxy glass may be employed.

Eighth Embodiment

Figure 6:
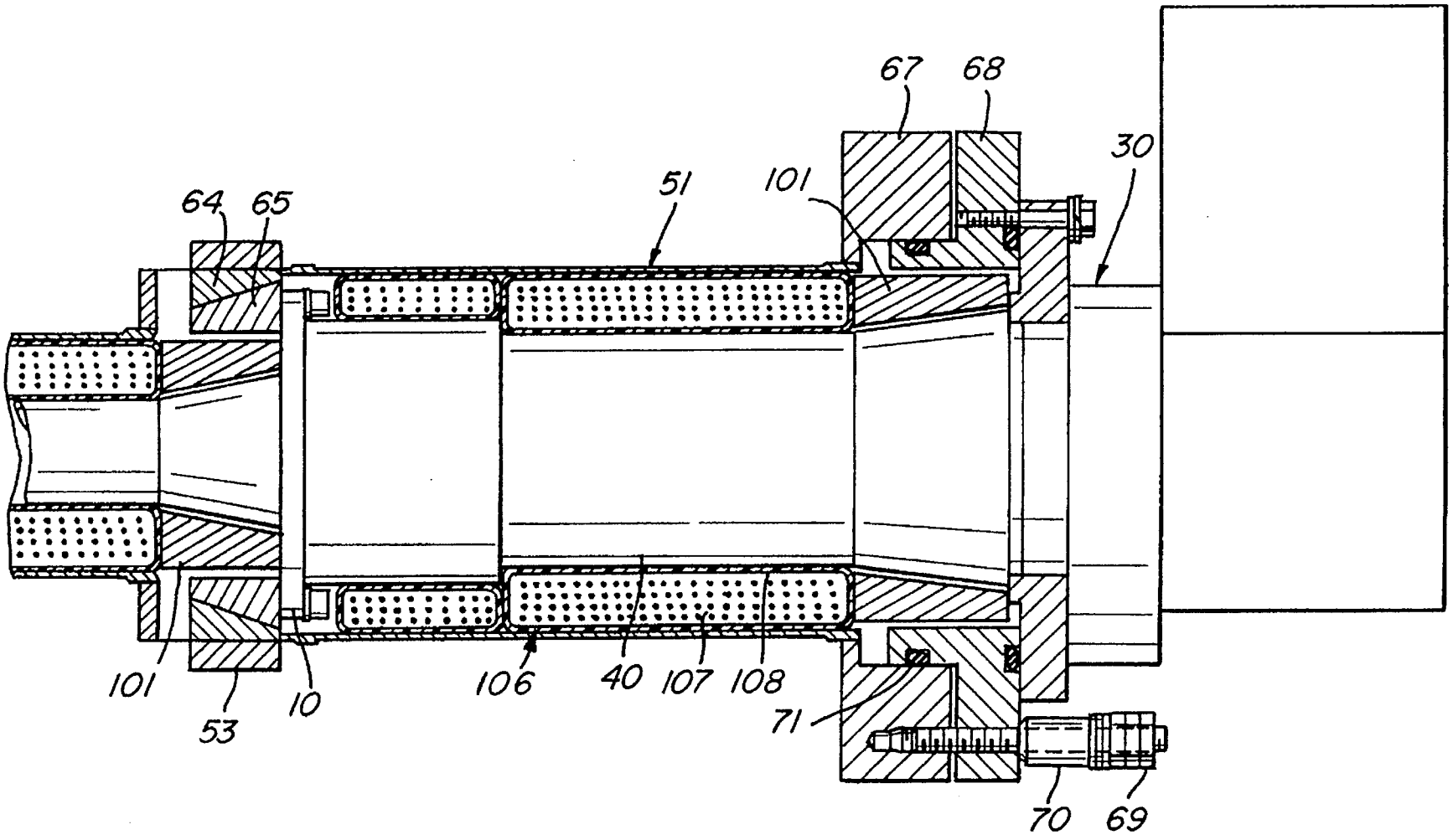
FIG. 6 is a cross sectional view which illustrates the structure of the connection established in the superconductive magnet according to an eighth embodiment of the present invention between the three-stage regenerative refrigerator and the cylinder for fastening the refrigerator.

An eighth embodiment is an embodiment of the present invention. FIG. 6 is a cross sectional view which illustrates an essential portion of the structure of the connection established in the superconductive magnet according to the eighth embodiment of the present invention between the three-stage regenerative refrigerator and the cylinder for fastening the refrigerator.

Referring to FIG. 6, reference numeral 106 represents a heat insulating filler serving as a heat insulator to be enclosed between the three-stage regenerative refrigerator 30 and the cylinder 51 for fastening the refrigerator 30. The heat insulating filler 106 is formed by bagging quartz sand 107 in a bag 108 made of Teflon.

Since the eighth embodiment is arranged in such a manner that the heat insulating filler 106 is constituted by bagging the quartz sand 107 in the bag 108, the cost can be reduced and handling can easily be performed. Further, the quartz sand 107 fluidizes in the bag 108 to be adaptable to the shape of the gap between the three-stage regenerative refrigerator 30 and the cylinder 51 for fastening the refrigerator 30. As a result, the gap can be closed and the heat convection can be prevented. Therefore, deterioration in the refrigerating performance of the refrigerator can be prevented.

Since the quartz sand 107 is a low-heat-conductive material, the heat conduction between a hot portion and a cold portion occurring in the cylinder 40 of the three-stage regenerative refrigerator 30 can be prevented.

Although the eighth embodiment is arranged so that the heat insulating filler 107 is formed by bagging the quartz sand 107 in the Teflon bag 108, the bag 108 is not limited to Teflon. Any material which is a low-heat-conductive material may be employed. For example, glass fiber cloth may be employed. The material to be bagged is not limited to the quartz sand 107 if the employed material is in the form of grains having a low-heat-conductivity. For example, granular glass or ceramic may be employed.

Ninth Embodiment

Figure 7:
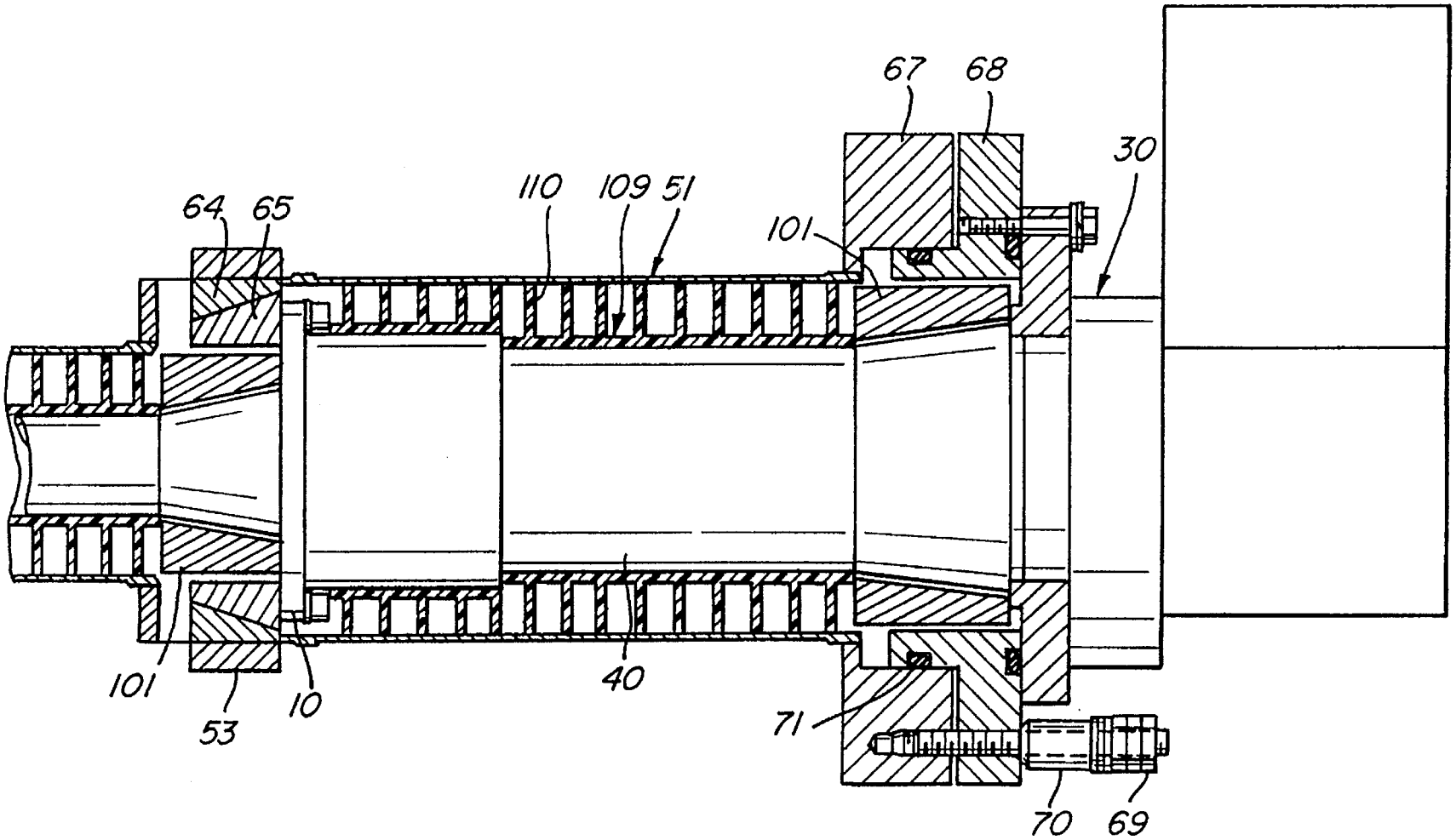
FIG. 7 is a cross sectional view which illustrates the structure of the connection established in the superconductive magnet according to a ninth embodiment of the present invention between the three-stage regenerative refrigerator and the cylinder for fastening the refrigerator.

A ninth embodiment is an embodiment of the present invention. FIG. 7 is a cross sectional view which illustrates an essential portion of the structure of the connection established in the superconductive magnet according to the ninth embodiment of the present invention between the three-stage regenerative refrigerator and the cylinder for fastening the refrigerator.

Referring to FIG. 7, reference numeral 109 represents a partition plate disposed between the three-stage regenerative refrigerator 30 and the cylinder 51 for fastening the refrigerator 30. The partition plate 109 is constituted by integrally forming a plurality of thin fins 110 on a sheet made of a low-heat-conductive material, for example, Teflon, to run parallel to the thin fins 110. The fins 110 are wound around and secured to the outer surface of the cylinder 40 in such a manner that the thin fins 110 be perpendicular to the three-stage regenerative refrigerator 30.

Since the ninth embodiment is so arranged that the gap between the three-stage regenerative refrigerator 30 and the cylinder 51 for fastening the refrigerator 30 is partitioned in a direction perpendicular to the axial direction of the three-stage regenerative refrigerator 30 by the fins 110 of the partition plate 109, the axial flow of the helium gas is prevented. As a result, deterioration in the refrigerating performance of the refrigerator can be prevented.

If the gap between the three-stage regenerative refrigerator 30 and the cylinder 51 for fastening the refrigerator 30 scatters and widened due to a dimensional error, the gap between the three-stage regenerative refrigerator 30 and the cylinder 51 for fastening the refrigerator 30 can be made small. As a result, a labyrinth effect prevents the axial flow of the helium gas. If the gap has been narrowed, the arrangement that the thickness of the fins 110 of the partition plate 109 is reduced to have elasticity causes the fins 110 to be inclined. As a result, the leading portions of the fins 110 are brought into contact with the cylinder 51 for fastening the refrigerator 30 so that generation of the axial flow of the helium gas is prevented.

Since the thickness of the fins 110 of the partition plate 109 is reduced to have elasticity, scattering of the inner and outer diameters of the cylinder 40 of the three-stage regenerative refrigerator 30 and the cylinder 51 for fastening the refrigerator 30 can be absorbed. As a result, the three-stage regenerative refrigerator 30 can be inserted into the cylinder 51 for fastening the refrigerator 30. Therefore, the assembling facility can be improved.

Tenth Embodiment

A tenth embodiment is another embodiment of the present invention. Although the ninth embodiment is so arranged that the partition plate 109 comprising a plurality of thin fins 110 integrally formed on the sheet to run parallel to the sheet is wound around and secured to the outer surface of the cylinder 40, the tenth embodiment is arranged in such a manner that an elongated Teflon sheet having a T-shape cross section is wound around and secured to the outer surface of the cylinder 40. In this case, a similar effect can be obtained.

Although the ninth and tenth embodiments employ Teflon as the material for making the partition plate 109, the partition plate 109 is not limited to Teflon if the employed material is a low-heat-conductive material. For example, a low-heat-conductive plastic or rubber material may be employed.

Although the ninth and tenth embodiments have the arrangement that a plurality of the fins 110 are disposed to run parallel to the axial direction of the three-stage regenerative refrigerator 30, it is sufficient to dispose one or more fins 110.

Although the ninth and tenth embodiments are arranged in such a manner that the partition plate 109 is secured to the outer surface of the cylinder 40, it may be secured to the inner surface of the cylinder 51 for fastening the refrigerator 30.

Eleventh Embodiment

Figure 8:
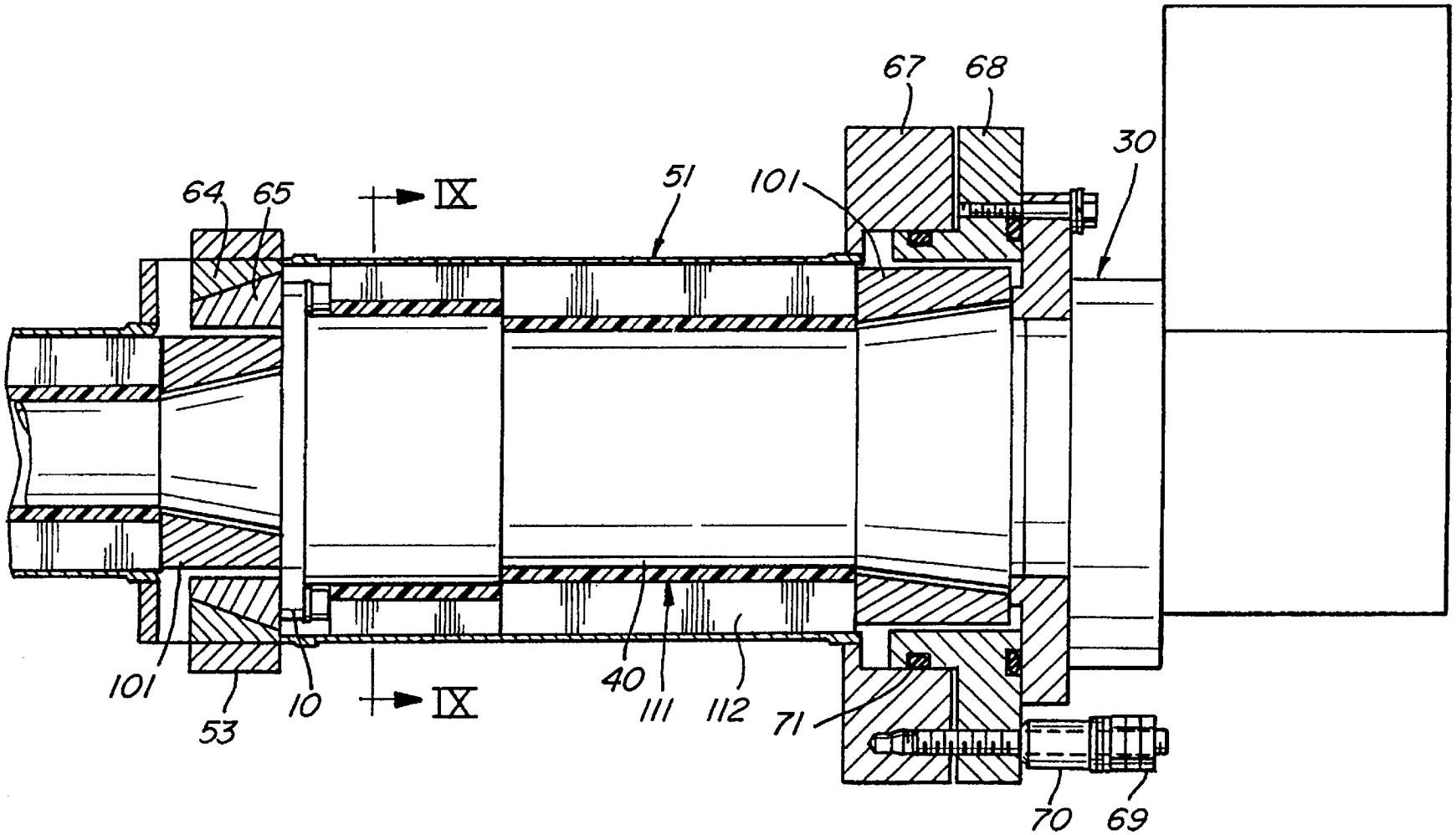
FIG. 8 is a cross sectional view which illustrates the structure of the connection established in the superconductive magnet according to an eleventh embodiment of the present invention between the three-stage regenerative refrigerator and the cylinder for fastening the refrigerator.
Figure 9:
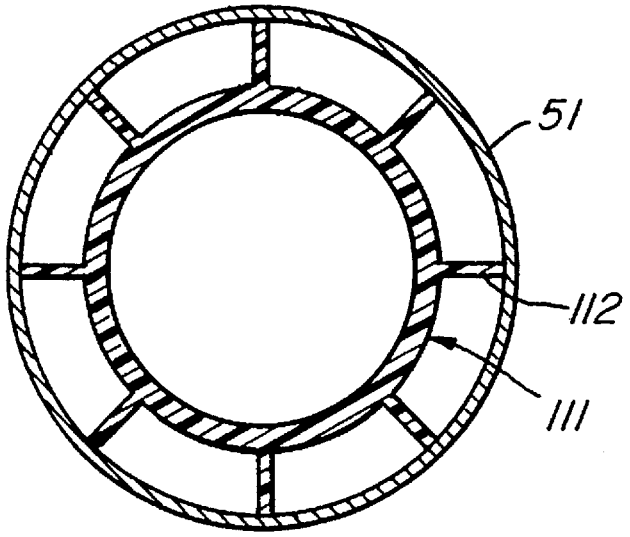
FIG. 9 is a cross sectional view taken along line IX—IX of FIG. 8.

An eleventh embodiment is an embodiment of the present invention. FIG. 8 is a cross sectional view which illustrates an essential portion of the structure of the connection established in the superconductive magnet according to the eleventh embodiment of the present invention between the three-stage regenerative refrigerator and the cylinder for fastening the refrigerator. FIG. 9 is a cross sectional view taken along line IX—IX of FIG. 9.

Referring to FIGS. 8 and 9, reference numeral 111 represents a partition plate disposed between the three-stage regenerative refrigerator 30 and the cylinder 51 for fastening the refrigerator 30. The partition plate 111 is constituted such that a plurality of thin fins 112 are integrally formed on a sheet made of, for example, Teflon to run parallel to the sheet. The partition plate 111 is wound and secured to the outer surface of the cylinder 40 so that the fins 112 are disposed in the axial direction of the three-stage regenerative refrigerator 30.

Since the eleventh embodiment is arranged such that the gap between the three-stage regenerative refrigerator 30 and the cylinder 51 for fastening the refrigerator 30 is partitioned in the circumferential direction of the three-stage regenerative refrigerator 30 by the fins 112 of the partition plate 111, the circumferential directional flow of the helium gas is prevented. As a result, deterioration in the refrigerating performance of the refrigerator can be prevented.

Figure 10:
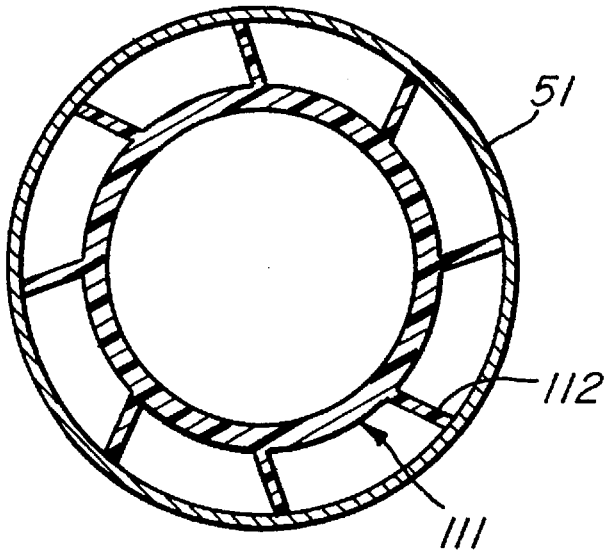
FIG. 10 is a cross sectional view which illustrates a state where a partition plate of the superconductive magnet according to the eleventh embodiment of the present invention is fastened.

The fins 112 of the partition plate 111 are made thin to have elasticity. Therefore, even if the gap between the three-stage regenerative refrigerator 30 and the cylinder 51 for fastening the refrigerator scatters, the fins 112 are inclined as shown in FIG. 10. As a result, the three-stage regenerative refrigerator 30 can be inserted into the cylinder 51 for fastening the refrigerator 30 while the leading portions of the fins 112 being brought into the inner surface of the cylinder 51 for fastening the refrigerator 30. Therefore, the assembling facility can be improved.

Although the eleventh embodiment is so arranged that the material of the partition plate 111 is Teflon, the partition plate 111 is not limited to Teflon if the employed material is a low-temperature-conductive material. For example, a low-heat-conductive plastic or rubber may be employed.

Although the eleventh embodiment is so arranged that a plurality of fins 112 are disposed to run parallel to the axial direction of the three-stage regenerative refrigerator 30, it is necessary that one or more fins 112 are disposed.

Twelfth Embodiment

Figure 11:
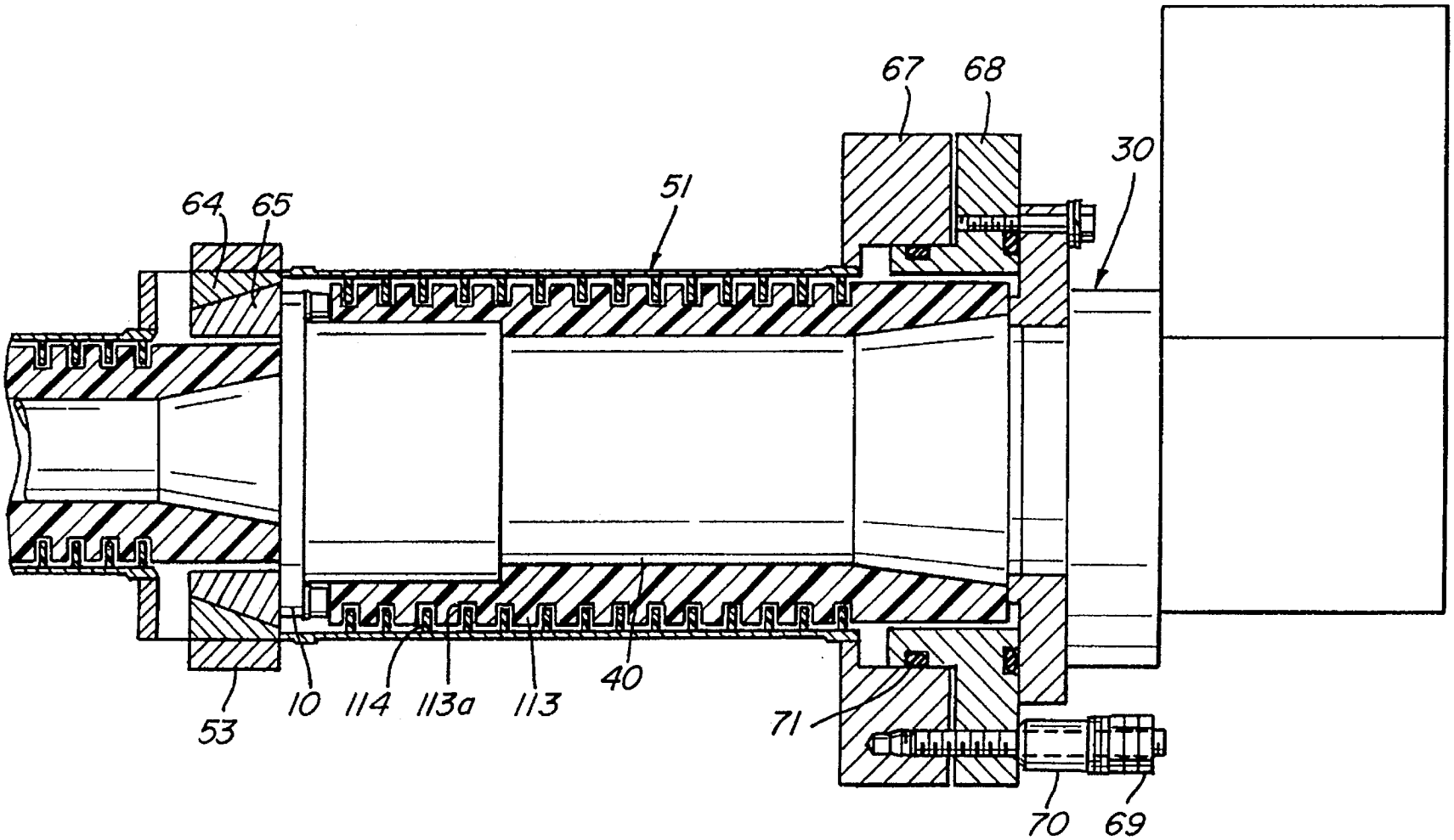
FIG. 11 is a cross sectional view which illustrates the structure of the connection established in the superconductive magnet according to a twelfth embodiment of the present invention between the three-stage regenerative refrigerator and the cylinder for fastening the refrigerator.

A twelfth embodiment is an embodiment of the present invention. FIG. 11 is a cross sectional view which illustrates an essential portion of the structure of the connection established in the superconductive magnet according to the twelfth embodiment of the present invention between the three-stage regenerative refrigerator and the cylinder for fastening the refrigerator.

Referring to FIG. 11, reference numeral 113 represents a tubular base serving as a low-heat-conductive base secured to the outer surface of the cylinder 40 of the three-stage regenerative refrigerator 30. The base 113 has, on the outer surface thereof, a plurality of grooves 113*a* formed in the circumferential direction thereof. Reference numeral 114 represents an annular sealant disposed in the groove 113*a* of the base 113, the annular sealants 114 sealing spaces from the cylinder 51 for fastening the refrigerator 30. The base 113 may be made of plastic or phenol resin or foamed material each of which is a low-heat-conductive material. The sealant 114 may be a Teflon piston ring or a ring made of Kapton sheet.

The twelfth embodiment is arranged in such a manner that the base 113 is disposed between the three-stage regenerative refrigerator 30 and the cylinder 51 for fastening the refrigerator 30. As a result, the heat convection can be prevented. Further, the sealants 114 prevent the axial flow of the helium gas occurring in the gap between the three-stage regenerative refrigerator 30 and the cylinder 51 for fastening the refrigerator 30. As a result, deterioration in the refrigerating performance of the refrigerator can be prevented.

Further, the disposition of the sealants 114 enables scattering occurring, during machining, in the inner and outer diameters of the cylinder 40 of the three-stage regenerative refrigerator 30 and the cylinder 51 for fastening the refrigerator 30. Therefore, the three-stage regenerative refrigerator 30 can be inserted into the cylinder 51 for fastening the refrigerator 30. As a result, the assembling facility can be improved.

Thirteenth Embodiment

Figure 12:
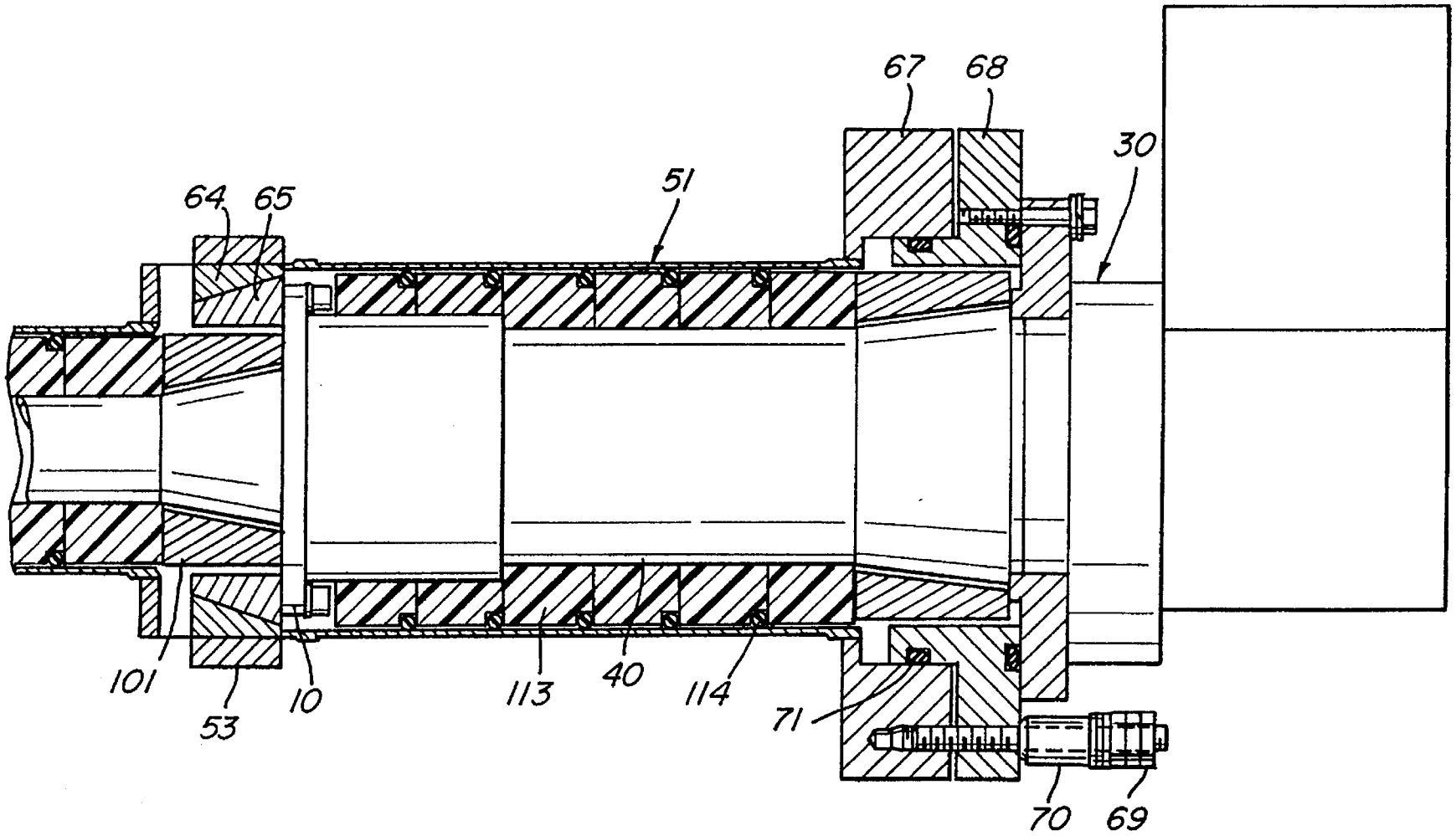
FIG. 12 is a cross sectional view which illustrates the structure of the connection established in the superconductive magnet according to a thirteenth embodiment of the present invention between the three-stage regenerative refrigerator and the cylinder for fastening the refrigerator.

A thirteenth embodiment is another embodiment of the present invention. Although the twelfth embodiment is arranged in such a manner that the tubular base 113 is made of an integrated member, the thirteenth embodiment is as shown in FIG. 12 arranged such that a tubular base 113 is sectioned. In this case, a similar effect can be obtained.

Figure 13A:
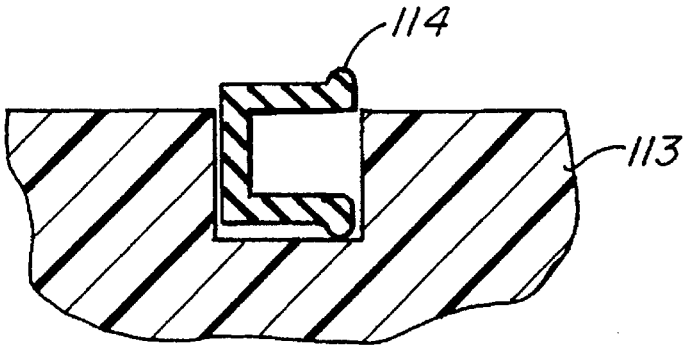
FIGS. 13A to 13C are cross sectional views which illustrate the shape of a sealant for use in the superconductive magnet according to the thirteenth embodiment of the present invention.
Figure 13B:
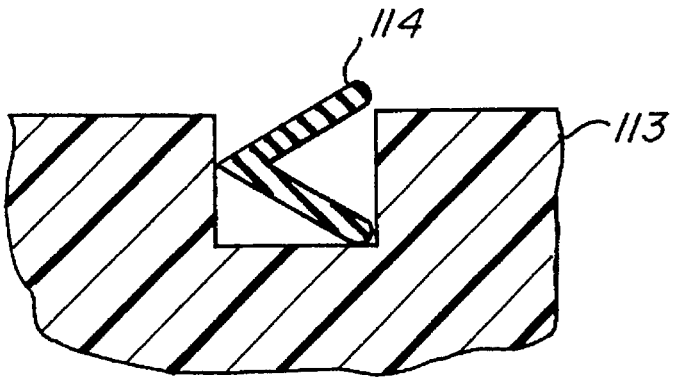
Figure 13C:
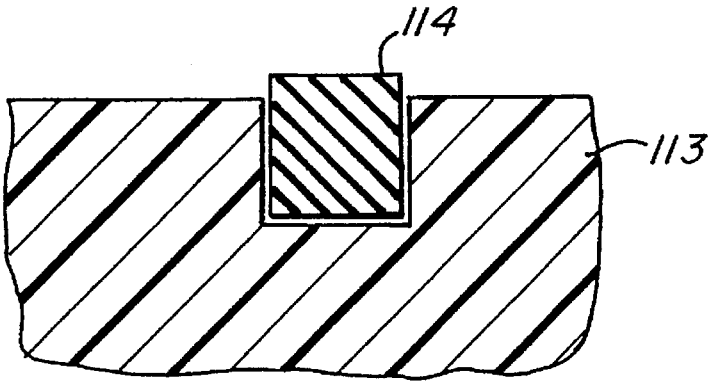

The sealant 114 is not limited to that having a C-shape cross section. It is necessary for the sealant 114 to have a sealing effect from the cylinder 51 for fastening the refrigerator 30. For example, a U-seal or a V-seal as shown in FIGS. 13A to 13C may be employed.

Fourteenth Embodiment

Figure 14:
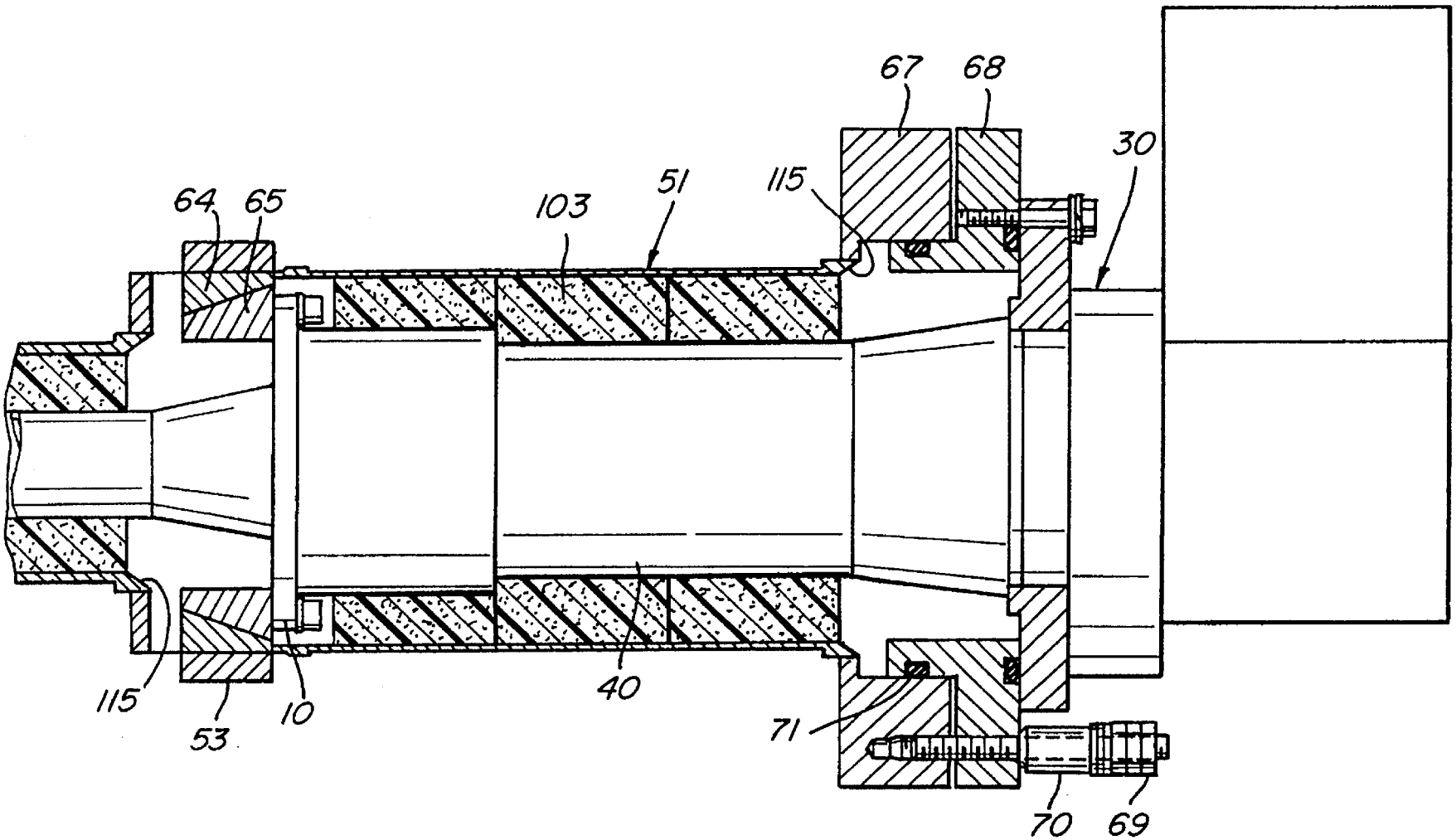
FIG. 14 is a cross sectional view which illustrates the structure of the connection established in the superconductive magnet according to a fourteenth embodiment of the present invention between the three-stage regenerative refrigerator and the cylinder for fastening the refrigerator.

A fourteenth embodiment is an embodiment of the present invention. FIG. 14 is a cross sectional view which illustrates an essential portion of the structure of the connection established in the superconductive magnet according to the fourteenth embodiment according to the present invention between the three-stage regenerative refrigerator and the cylinder for fastening the refrigerator.

Referring to FIG. 14, reference numeral 115 represents a tapered surface formed in the inlet port of the cylinder 51 for fastening the refrigerator 30 for inserting the refrigerator 30.

Since the fourteenth embodiment is so arranged that the tapered surface 115 in the inlet port of the cylinder 51 for fastening the refrigerator 30 for inserting the refrigerator 30, the sponge-like material 103 is not caught by the inlet port of the refrigerator at the time of inserting the three-stage regenerative type refrigerator 30 to which the sponge-like material 103 serving as the heat insulator is secured to the outer surface thereof. Therefore, it is guided by the tapered surface and inserted smoothly. As a result, the assembling facility can be improved.

Fifteenth Embodiment

A fifteenth embodiment is an embodiment of the present invention. The fifteenth embodiment is arranged in such a manner that the three-stage regenerative refrigerator 30, that is, the cylinder 51 for fastening the refrigerator 30 is fastened to make an angle of 15° from the horizontal surface.

The helium gas enclosed between the three-stage regenerative refrigerator 30 and the cylinder 51 for fastening the refrigerator 30 flows due to the pressure difference of the helium gas occurring between the upper surface of the cylinder and the lower surface of the same due to the upward movement of the helium gas generated from the lower surface to the upper surface of the cylinder in the circumferential direction of the cylinder in the hot portion of each stage of the cylinder 40 and the pressure difference of the helium gas occurring between the upper surface of the cylinder and the lower surface of the same due to the downward movement of the helium gas generated from the upper surface to the lower surface of the cylinder in the circumferential direction of the cylinder in the low temperature portion. The flow is made from the lower surface portion of the low temperature portion to the lower surface portion of the low temperature portion via the lower surface portion of the hot portion, the upper surface portion of the hot portion and the upper surface portion of the low temperature portion in this sequential order. As a result, a heat convection is generated.

However, the arrangement of the fifteenth embodiment so made that the three-stage regenerative refrigerator 30 makes the angle of 15° from the horizontal surface decreases the pressure difference occurring between the upper surface of the cylinder 40 and the lower surface of the same in the hot portion of each stage of the cylinder 40 and pressure difference occurring between the upper surface of the cylinder and the lower surface of the same in the low temperature portion. As a result, the heat convection can be prevented, causing the refrigerating performance to be improved.

Since the heat convection between the three-stage regenerative refrigerator 30 and the cylinder 51 for fastening the refrigerator 30 is restricted, the heat insulator to be enclosed may be omitted. In this case, the assembling facility can be improved.

If the angle made by the fastened three-stage regenerative refrigerator 30 is smaller than 10°, the pressure difference occurring between the upper surface of the cylinder 40 and the lower surface of the same in the hot portion of each stage of the cylinder 40 and pressure difference occurring between the upper surface of the cylinder and the lower surface of the same in the low temperature portion cannot be decreased. The heat convection is undesirably generated. If it is larger than 25°, the length of the cylinder 40 must be secured for the purpose of obtaining desired refrigerating performance. Therefore, long intervals must be maintained among the first and second heat shield 6 and 5 and the vacuum layer. In this case, the size of the apparatus cannot be reduced. Therefore, it is preferable that the three-stage regenerative refrigerator 30 must be fastened to make an angle of 10° to 25°.

Sixteenth Embodiment

Figure 15:
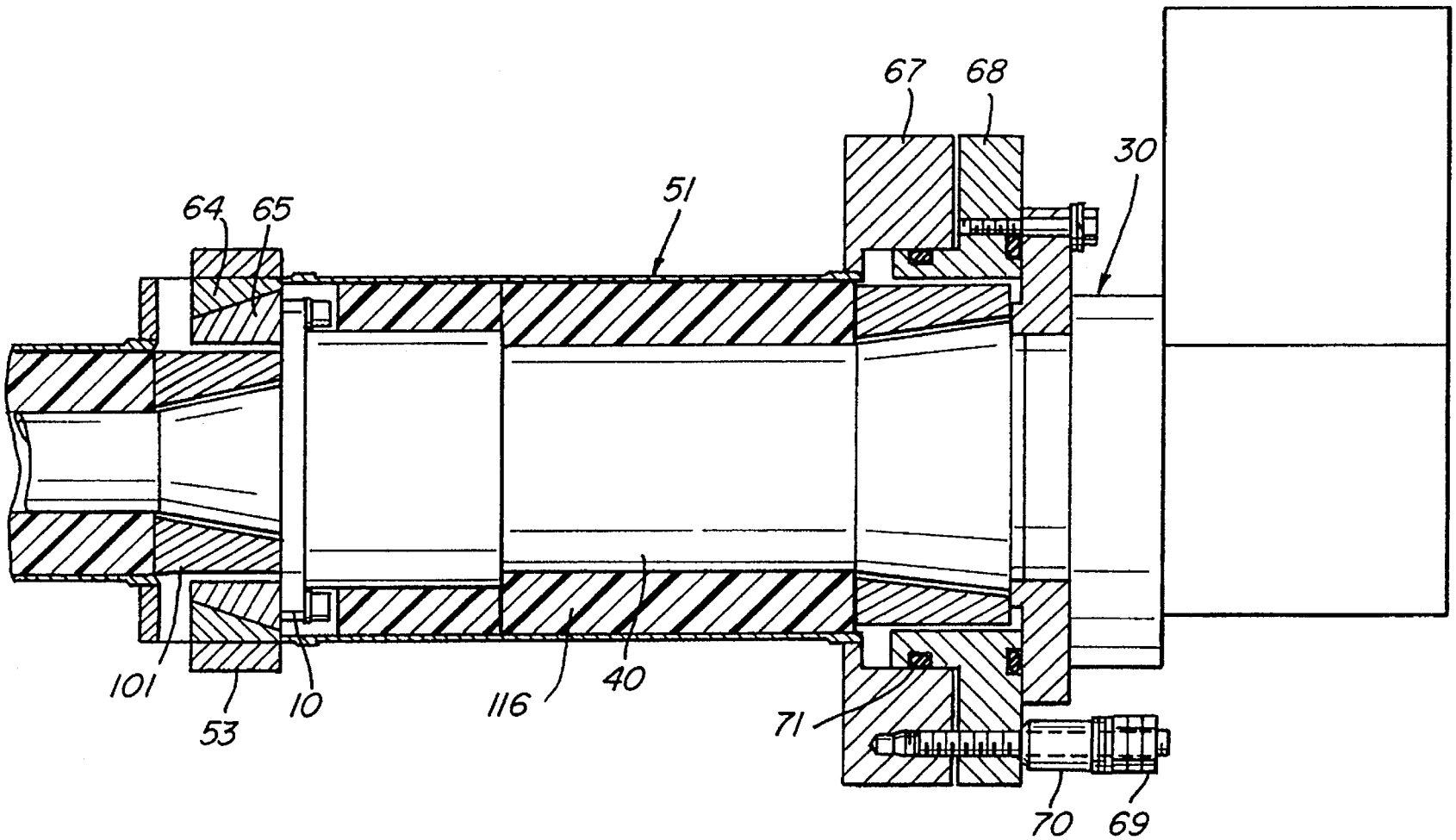
FIG. 15 is a cross sectional view which illustrates the structure of the connection established in the superconductive magnet according to a sixteenth embodiment of the present invention between the three-stage regenerative refrigerator and the cylinder for fastening the refrigerator.

A sixteenth embodiment is an embodiment of the present invention. FIG. 15 is a cross sectional view which illustrates an essential portion of the structure of the connection established in the superconductive magnet according to the sixteenth embodiment according to the present invention between the three-stage regenerative refrigerator and the cylinder for fastening the refrigerator.

Referring to FIG. 15, reference numeral 116 represents a tube serving as a heat insulator fastened to the outer surface of the cylinder 40 of the three-stage regenerative refrigerator 30. The tube 116 has the inner diameter which is the same as the outer diameter of the cylinder 40 and the outer diameter of which is the same as the inner diameter of the cylinder 51 for fastening the refrigerator 30. Further, the tube 116 is constituted while being divided into two sections in the axial direction of the refrigerator. The tube 116 may be made of a low-heat-conductive material, for example, phenol resin or epoxy glass resin.

Since the sixteenth embodiment has the arrangement that the tube 116 is divided into two sections, the tube 116 can easily be fastened. As a result, the assembling facility can be improved.

By improving the machining accuracy of the tube 116, the gap from the cylinder 51 for fastening the refrigerator 30 can be reduced and the heat convection can be restricted.

Seventeenth Embodiment

Figure 16:
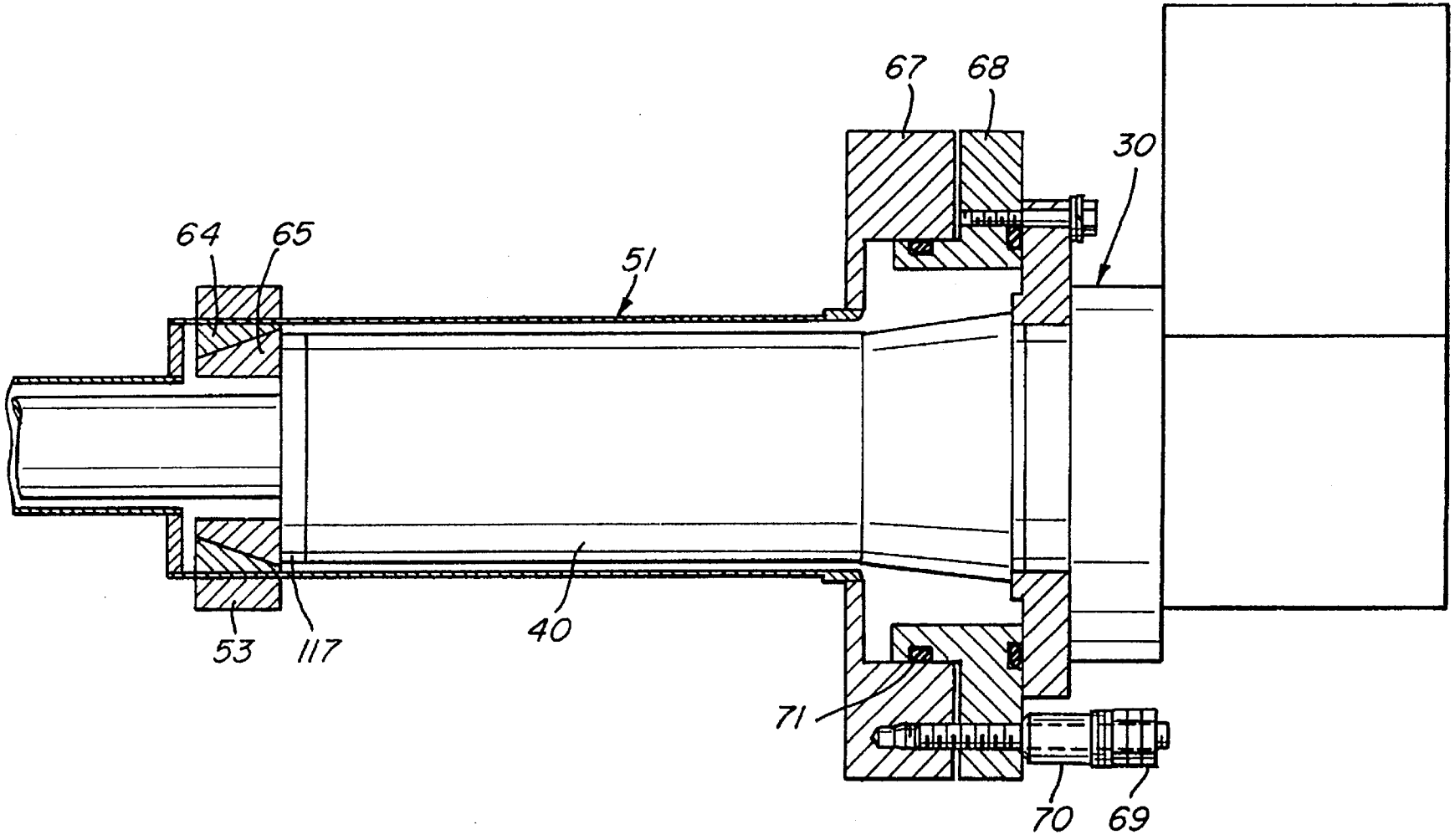
FIG. 16 is a cross sectional view which illustrates the structure of the connection established in the superconductive magnet according to a seventeenth embodiment of the present invention between the three-stage regenerative refrigerator and the cylinder for fastening the refrigerator.

A seventeenth embodiment is an embodiment of the present invention. FIG. 16 is a cross sectional view which illustrates an essential portion of the structure of the connection established in the superconductive magnet according to the seventeenth embodiment of the present invention between the three-stage regenerative refrigerator and the cylinder for fastening the refrigerator.

Referring to FIG. 16, reference numeral 117 represents a hollow annular heat stage so fastened to the cylinder 40 as not to project the outline of the cylinder 40.

Since the seventeenth embodiment is so arranged that the heat stage 117 fastened to the cylinder 40 does not project over the outline of the cylinder 40, the gap between the three-stage regenerative refrigerator 30 and the cylinder for fastening the refrigerator 30 can be reduced if the cylinder 51 for fastening the refrigerator 30 is machined to have the inner diameter which is substantially the same as the outer diameter of the cylinder 40. Therefore, the heat convection can be restricted while eliminating the necessity of fastening the heat insulator. As a result, the refrigerating performance can be improved.

Eighteenth Embodiment

Figure 17:
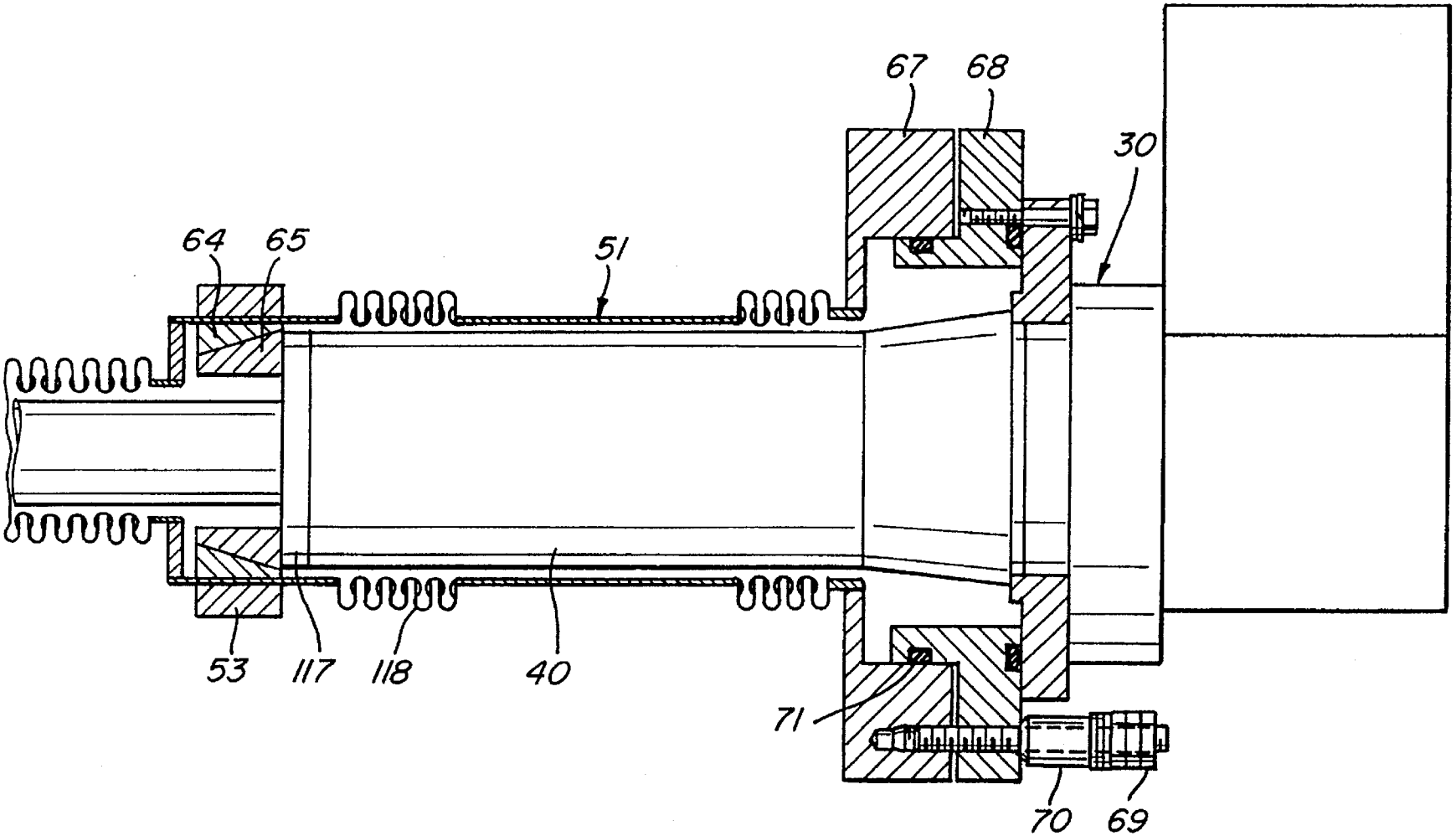
FIG. 17 is a cross sectional view which illustrates the structure of the connection established in the superconductive magnet according to an eighteenth embodiment of the present invention between the three-stage regenerative refrigerator and the cylinder for fastening the refrigerator.

An eighteenth embodiment is another embodiment of the present invention. FIG. 17 is a cross sectional view which illustrates an essential portion of the structure of the connection established in the superconductive magnet according to the eighteenth embodiment of the present invention between the three-stage regenerative refrigerator and the cylinder for fastening the refrigerator.

The eighteenth embodiment is so arranged that bellows 118 are fastened to the cylinder 51 for fastening the refrigerator 30. Therefore, by fastening the heat stage 117 to the cylinder 40 so as not to project over the outline of the cylinder 40, by machining the cylinder 51 for fastening the refrigerator 30 to have the inner diameter which is substantially similar to the outer diameter of the cylinder 40, and by making the gap between the three-stage regenerative refrigerator 30 and the cylinder 51 for fastening the refrigerator 30 to be small, stress generative due to the axial deviation occurring in each stage of the cylinder and the dimensional error or the like can be absorbed by the bellows 118.

Nineteenth Embodiment

Figure 18:
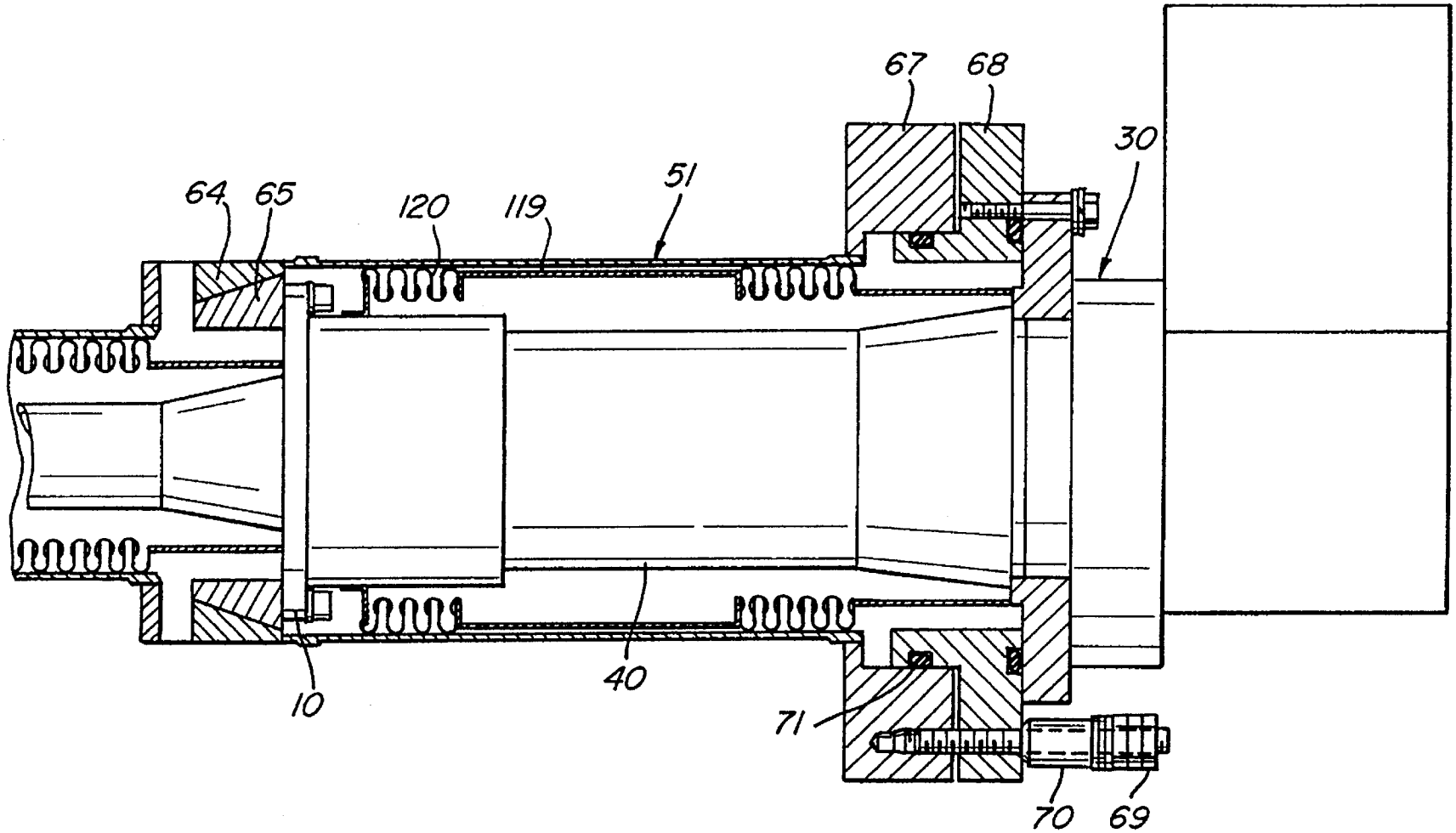
FIG. 18 is a cross sectional view which illustrates the structure of the connection established in the superconductive magnet according to a nineteenth embodiment of the present invention between the three-stage regenerative refrigerator and the cylinder for fastening the refrigerator.
Figure 19:
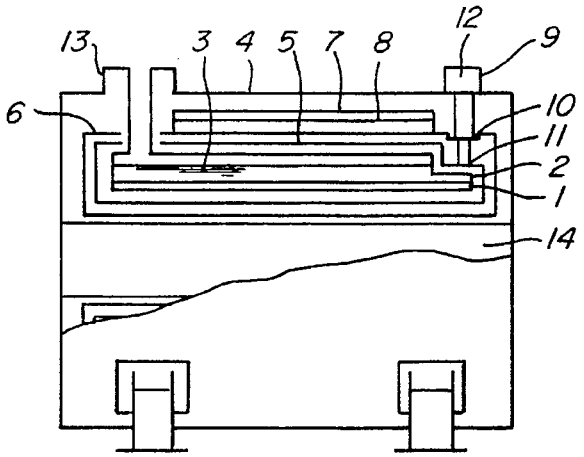
FIG. 19 is a cross sectional view which illustrates an example of a conventional superconductive magnet.
Figure 20:
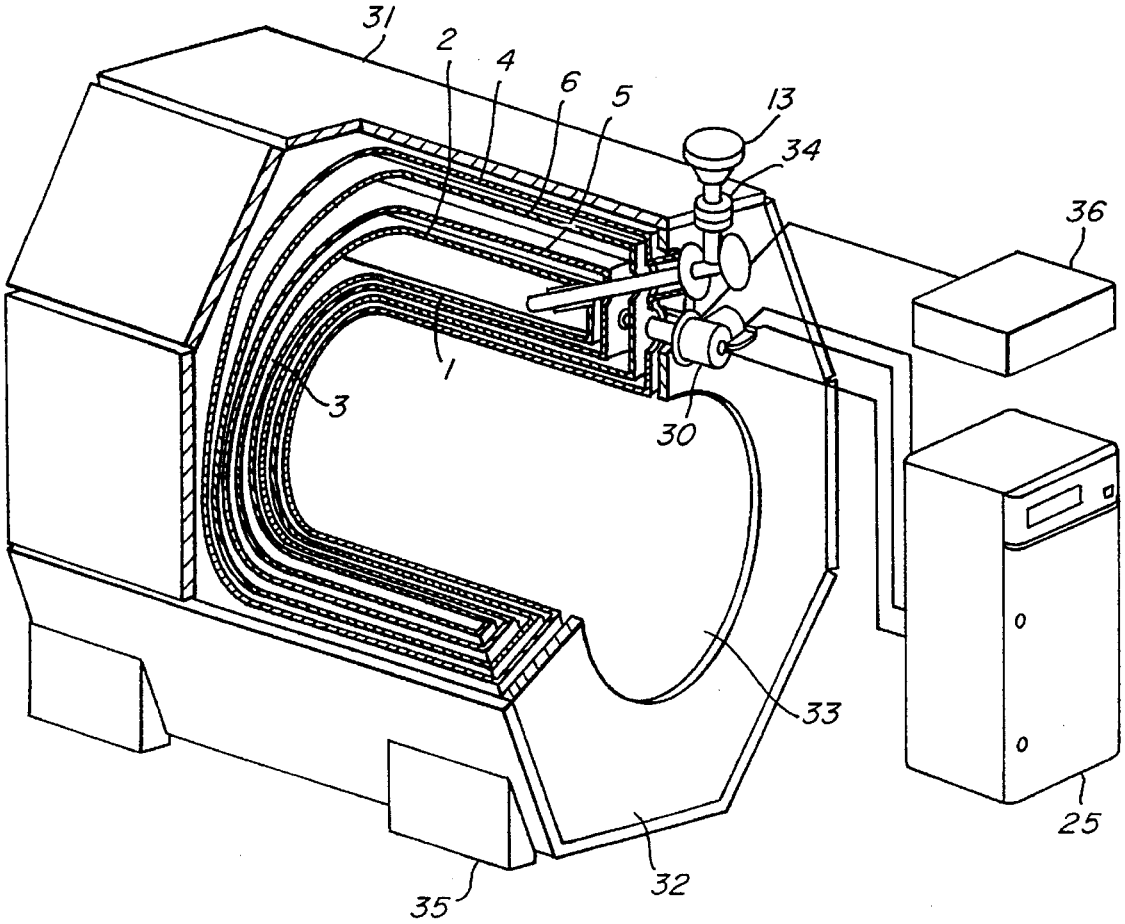
FIG. 20 is a partially-broken away perspective view which illustrates another example of a conventional superconductive magnet.
Figure 21:
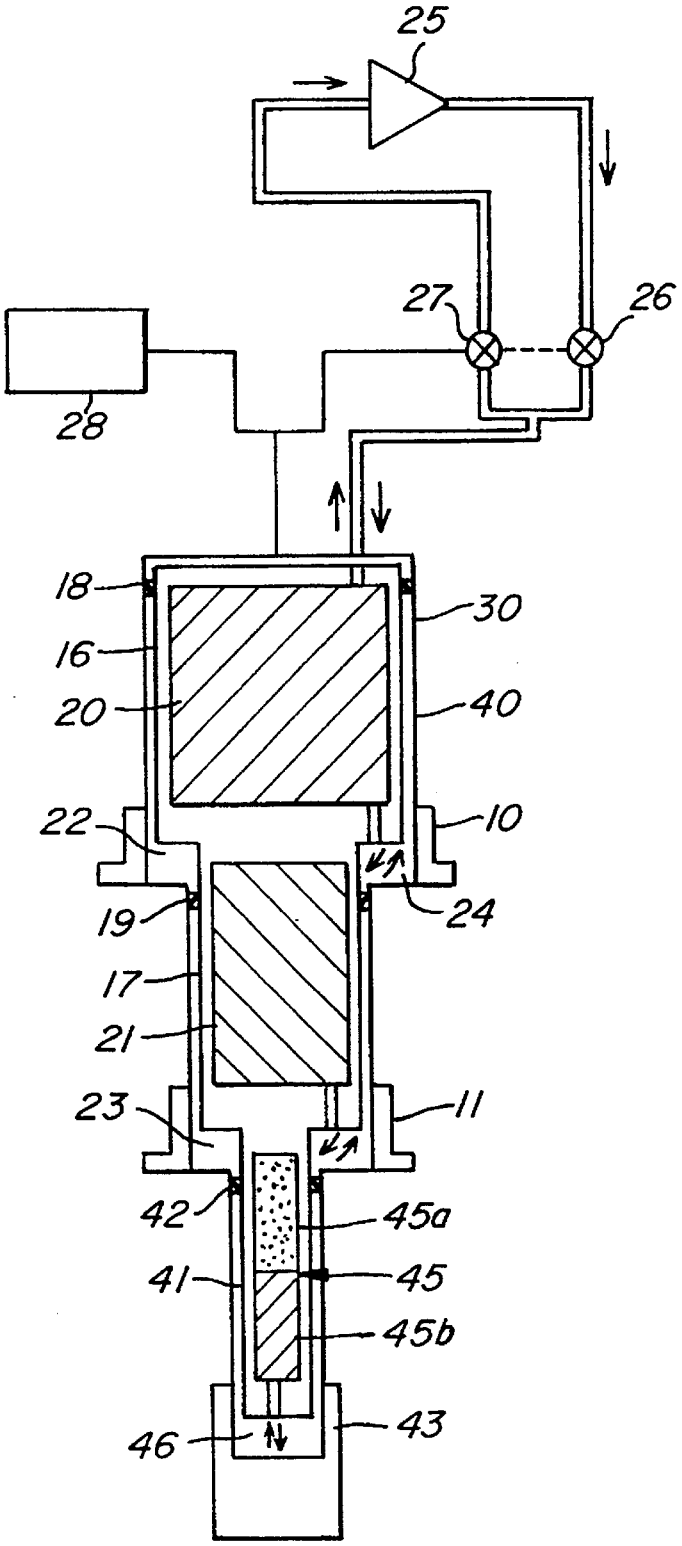
FIG. 21 is a schematic cross sectional view which illustrates the structure of the three-stage regenerative refrigerator of the conventional superconductive magnet.
Figure 22:
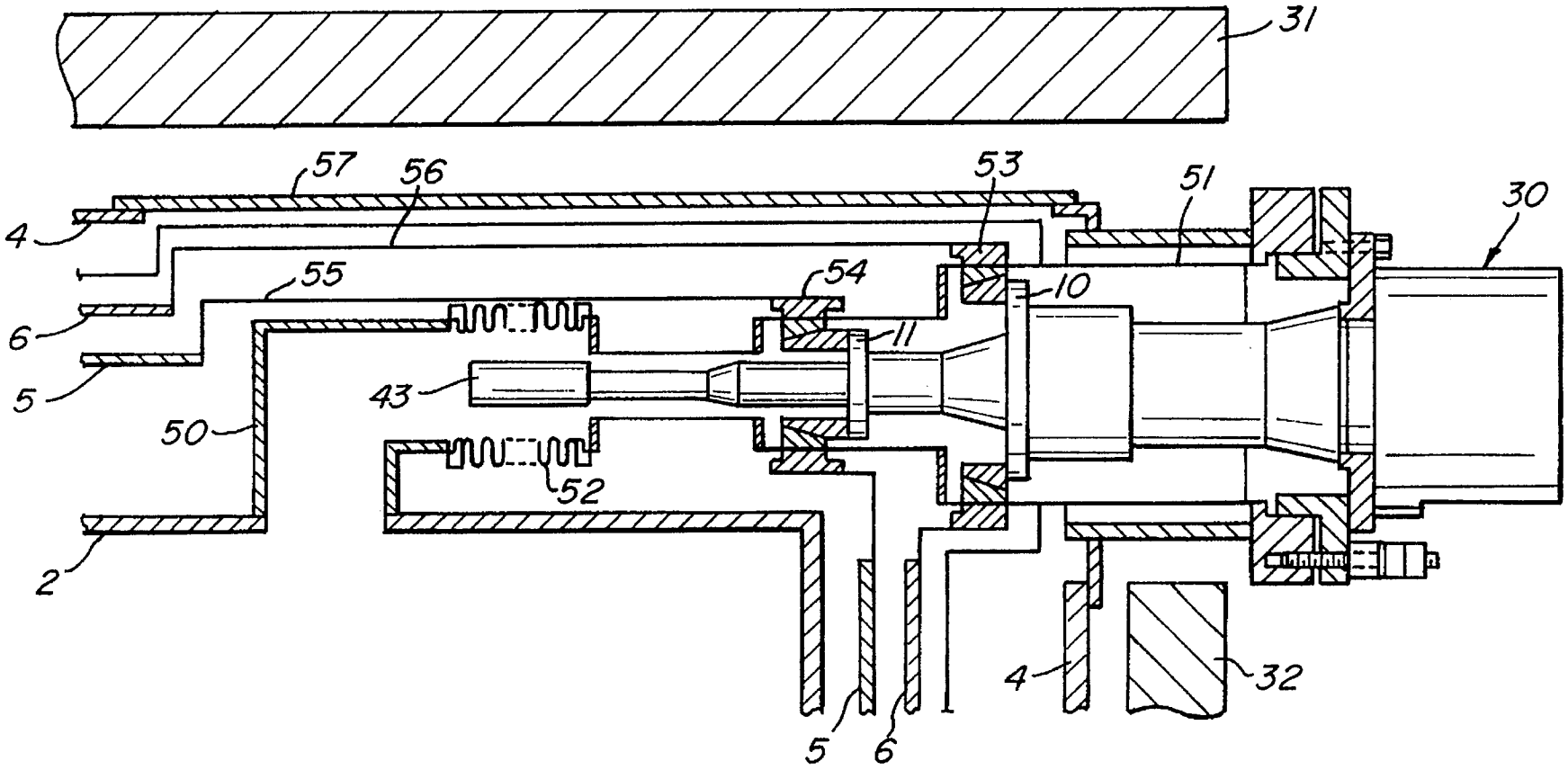
FIG. 22 is a schematic cross sectional view which illustrates the structure for fastening the three-stage regenerative refrigerator of the conventional superconductive magnet.
Figure 23:
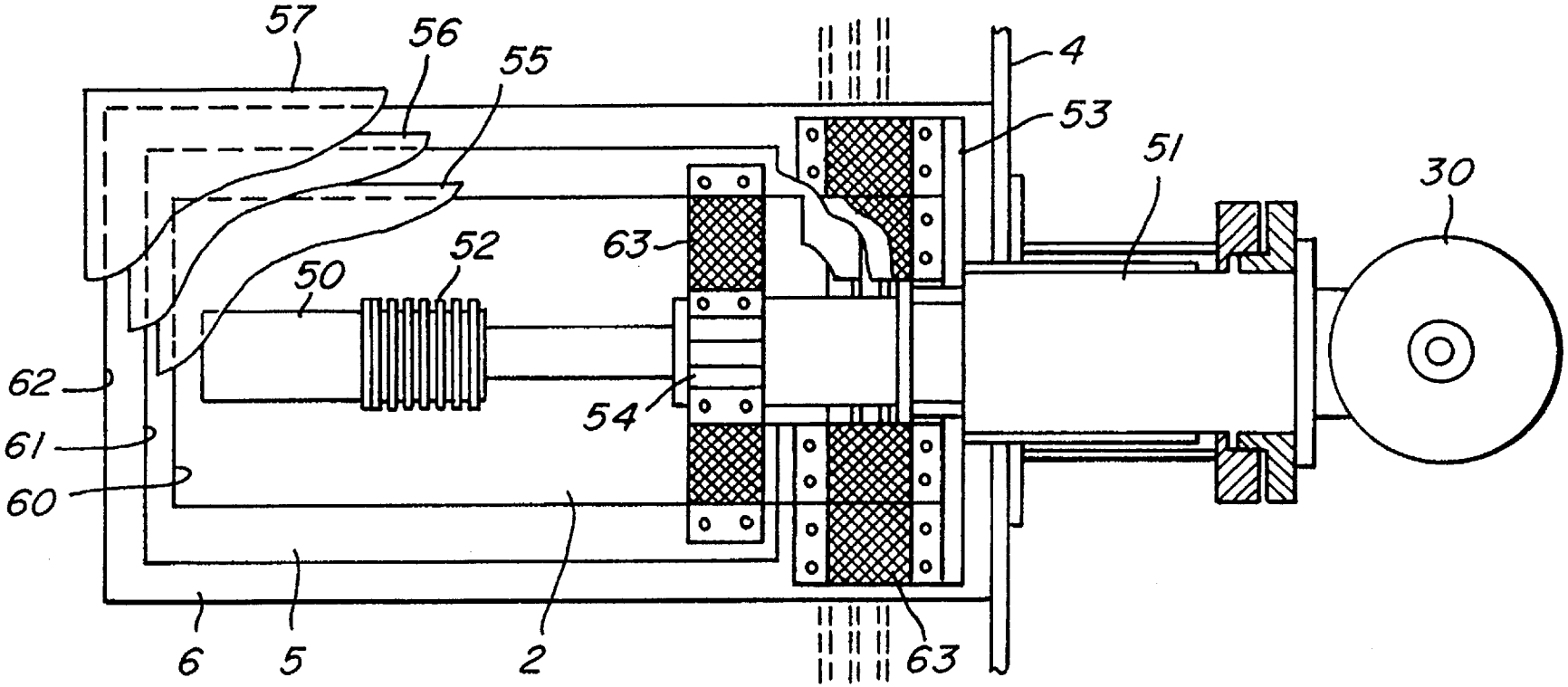
FIG. 23 is a partially-broken plan view which illustrates the structure for connecting the cylinder for fastening the refrigerator and the heat shield to each other in the conventional superconductive magnet.
Figure 24:
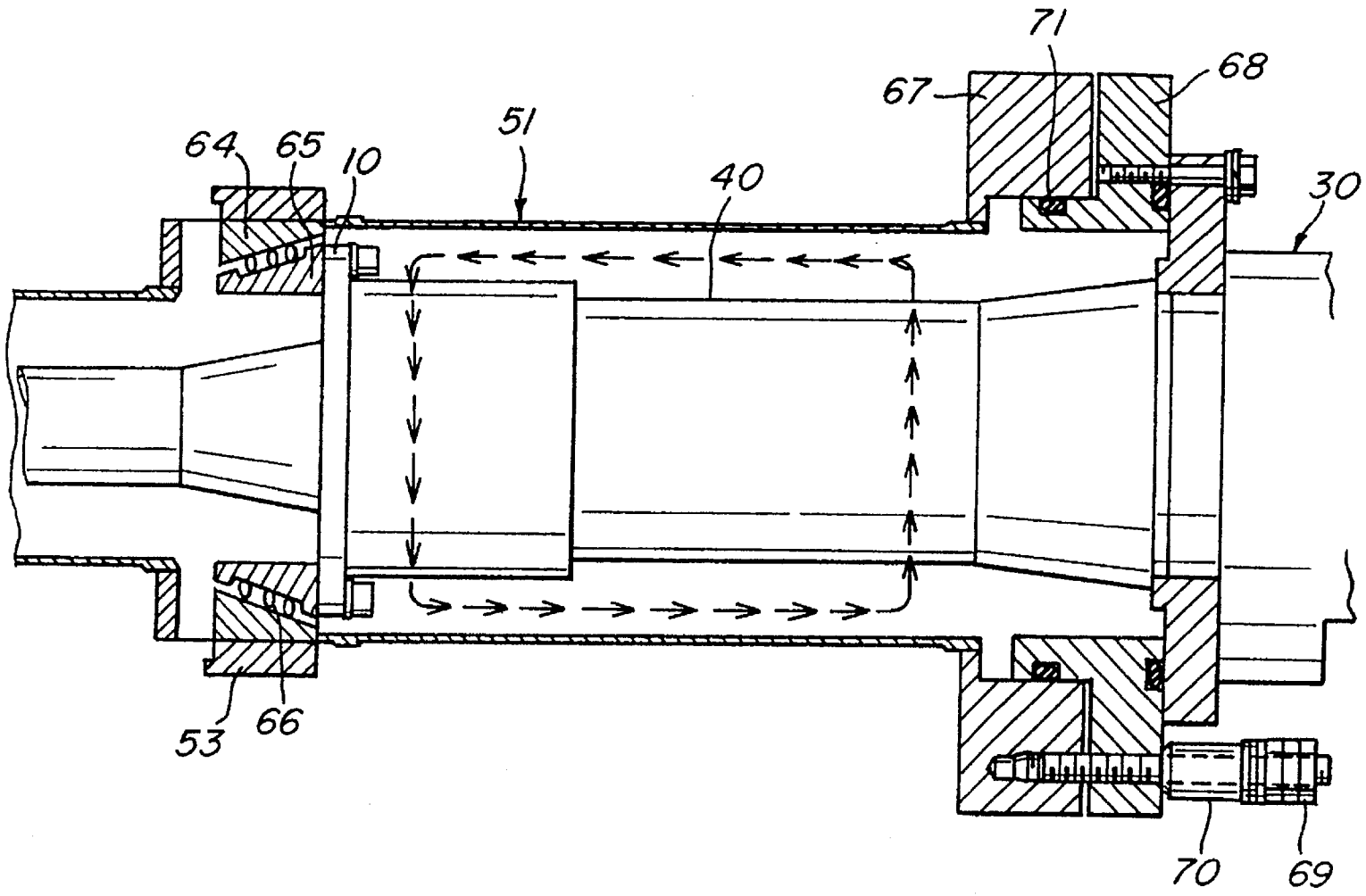
FIG. 24 is a cross sectional view which illustrates the structure of the connection established in a conventional superconductive magnet between a three-stage regenerative refrigerator and a cylinder for fastening the refrigerator.

A nineteenth embodiment is an embodiment of the present invention. FIG. 18 is a cross sectional view which illustrates an essential portion of the structure of the connection established in the superconductive magnet according to the nineteenth embodiment of the present invention between the three-stage regenerative refrigerator and the cylinder for fastening the refrigerator.

Referring to FIG. 18, reference numeral 119 represents a sub-cylinder formed to have the outer diameter which is substantially the same as the inner diameter of the cylinder 51 for fastening the refrigerator 30 and having bellows 120 fastened thereto. The sub-cylinder 119 is fastened to the outer surface of the cylinder 40 of the three-stage regenerative refrigerator 30 and inserted into the cylinder 51 for fastening the refrigerator 30.

Since the nineteenth embodiment is so arranged that the sub-cylinder 119 has the outer diameter which is substantially the same as the inner diameter of the cylinder 51 for fastening the refrigerator 30, the gap from the cylinder 51 for fastening the refrigerator 30 can be reduced. Therefore, the heat convection can be restricted and the refrigerating performance can be improved.

If stress is applied to the three-stage regenerative refrigerator 30 due to the axial deviation or the like of the cylinder 40 at the time of inserting the three-stage regenerative refrigerator 30 into the cylinder 51 for fastening the refrigerator 30, the stress can be absorbed by the bellows 120 of the sub-cylinder 119.

Although the superconductive magnet according to each embodiment is arranged to be adapted to a magnet resonance image diagnosing apparatus, the present invention may be adapted to a magnetic levitation train, a synchrotron radiation or a crystal pulling apparatus or the like.

Although each embodiment is so arranged as to be adapted to the three-stage regenerative refrigerator disposed substantially in parallel to the axial direction of the cylindrical superconductive coil 1, the present invention is not limited to this. For example, the present invention may be adapted to a three-stage regenerative refrigerator horizontally disposed in a superconductive coil formed into a race track shape.

Although each embodiment is arranged to be adapted to the three-stage regenerative refrigerator 30, the present invention may be adapted to any refrigerator of a type comprising a heat stage, a portion of which has refrigerating performance capable of reliquefying liquid helium. The present invention may be a two stage regenerative refrigerator or a four stage regenerative refrigerator.

Since the present invention is constituted as described above, the following effects can be obtained.

Since the superconductive magnet according to the present invention is so arranged that the string-like heat insulator is wound around the outer surface of the cylinder of a multi-stage regenerative refrigerator, the heat insulator can easily be wound, the shape and the dimensions can be determined satisfactorily freely and heat insulation adaptable to the clearance between the cylinder of the multi-stage regenerative refrigerator and the cylinder for fastening the refrigerator can easily be realized. Further, the heat insulator is enclosed between the cylinder of the multi-stage regenerative refrigerator and the cylinder for fastening the refrigerator so that the heat convection of the very low temperature refrigerant can be prevented, heat can efficiently be insulated and the refrigerating performance can be improved.

Since the superconductive magnet according to the present invention is so arranged that the cylindrical and sponge-like heat insulator is wound around the outer surface of the multi-stage regenerative refrigerator, heat insulation adaptable to the clearance between the cylinder of the multi-stage regenerative refrigerator and the cylinder for fastening the refrigerator can easily be realized. Further, the heat insulator is enclosed between the cylinder of the multi-stage regenerative refrigerator and the cylinder for fastening the refrigerator so that the heat convection of the very low temperature refrigerant can be prevented, heat can efficiently be insulated and the refrigerating performance can be improved.

Since the superconductive magnet according to the present invention is so arranged that the cylindrical and sponge-like heat insulator having the cover on the outer surface thereof is fastened to the outer surface of the cylinder of the multi-stage regenerative refrigerator, the multi-stage regenerative refrigerator having the heat insulator fastened thereto can easily be inserted. As a result, the assembling facility can be improved.

Since the superconductive magnet according to the present invention is so arranged that the tubular heat insulator to which the sponge-like heat insulating materials are secured to the inner and outer surfaces thereof is fastened to the outer surface of the cylinder of the multi-stage regenerative refrigerator, the sponge-like heat insulating materials can be integrated to the heat insulator to be easily fastened to the multi-stage regenerative refrigerator and easily inserted into the cylinder for fastening the refrigerator. As a result, the assembling facility can be improved.

Since the superconductive magnet according to the present invention is so arranged that the heat insulator formed by bagging the granular heat insulating material is enclosed between the multi-stage regenerative refrigerator and the cylinder for fastening the refrigerator, the granular heat insulating material fluidizes in the bag so that the heat insulator can be enclosed between the multi-stage regenerative refrigerator and the cylinder for fastening the refrigerator without gap. As a result, the heat convection of the very low temperature refrigerant gas can be prevented and the cost of the heat insulator can be reduced.

Since the superconductive magnet according to the present invention is so arranged that the partition plate for partitioning the flow of the very low temperature refrigerant gas in the axial direction of the multi-stage regenerative refrigerator is disposed between the multi-stage regenerative refrigerator and the cylinder for fastening the refrigerator, the axial flow of the very low temperature refrigerant gas can be prevented and the heat convection can be restricted. As a result, dimensional scattering of the cylinder due to the machining accuracy can be absorbed.

Since the superconductive magnet according to the present invention is so arranged that the partition plate for partitioning the flow of the very low temperature refrigerant gas in the circumferential direction of the multi-stage regenerative refrigerator is disposed between the multi-stage regenerative refrigerator and the cylinder for fastening the refrigerator, the circumferential directional flow of the very low temperature refrigerant gas can be prevented and the heat convection can be restricted. Further, dimensional scattering of the cylinder due to the machining accuracy can be absorbed.

Since the superconductive magnet according to the present invention is so arranged that the tubular and low-heat-conductive base is fastened to the outer surface of the cylinder of the multi-stage regenerative refrigerator and a sealant for sealing the space from the inner surface of the cylinder for fastening the refrigerator is fastened to the low-heat-conductive base, the flow of the very low temperature refrigerant gas can be prevented and the heat convection can be restricted. Further, dimensional scattering of the cylinder due to the machining accuracy can be absorbed.

Since the superconductive magnet according to the present invention is so arranged that the inlet port of the cylinder for fastening the refrigerator, through which the refrigerator is inserted, is tapered, the heat insulator can easily be inserted and the assembling facility can be improved.

Since the superconductive magnet according to the present invention is so arranged that the angle made by the fastened multi-stage regenerative refrigerator is 10° to 25°, the heat convection of the very low temperature refrigerant gas between the multi-stage regenerative refrigerator and the cylinder for fastening the refrigerator can be prevented while reducing the size of the apparatus.

Since the superconductive magnet according to the present invention is so arranged that the heat insulator is formed into the tube divided into two sections in the axial direction, the heat insulator can easily be fastened to the multi-stage regenerative refrigerator.

Since the superconductive magnet according to the present invention is so arranged that projection of the heat stage of the multi-stage regenerative refrigerator over the outline of the cylinder of the multi-stage regenerative refrigerator is inhibited, the gap between the cylinder of the multi-stage regenerative refrigerator and the cylinder for fastening the refrigerator can be reduced. Therefore, the heat convection can be restricted without the heat insulator.

Since the superconductive magnet according to the present invention is so arranged that the sub-cylinder having the outer diameter which is substantially the same as the inner diameter of the cylinder for fastening the refrigerator is, via the bellows, fastened to the outer surface of the cylinder of the multi-stage regenerative refrigerator, the gap between the cylinder of the multi-stage regenerative refrigerator and the cylinder for fastening the refrigerator can be reduced, the heat convection can be restricted and the axial deviation of the cylinder of the multi-stage regenerative refrigerator can be absorbed.

What is claimed is:

1. A superconductive magnet, comprising:

a superconductive coil;

a very low refrigerant chamber for accommodating said superconductive coil and reserving a very low temperature refrigerant for cooling said superconductive coil;

a heat shield for surrounding said very low temperature refrigerant;

a vacuum chamber for surrounding said heat shield;

a first cylinder, connected to the vacuum chamber, for fastening a multi-stage regenerative refrigerator such that an end of the refrigerator faces an ambience of very low temperature refrigerant gas evaporating in said very low temperature refrigerant chamber, the refrigerator extending into the first cylinder substantially horizontally;

wherein the multi-stage regenerative refrigerator is inserted in and secured to said first cylinder to reliquefy very low temperature refrigerant gas introduced into said first cylinder in at least a portion of a heat stage of said refrigerator;

a heat insulator disposed on an outer surface of a second cylinder of said multi-stage regenerative refrigerator for substantially an entire axial length of the second cylinder, the heat insulator restricting the escape of the gas from the refrigerant chamber; and a spacer, disposed at one end of the heat insulator, the spacer being constructed and arranged to prevent axial slip of the heat insulator with respect to the second cylinder.

2. A superconductive magnet according to claim 1, wherein said heat insulator is a string-like heat insulator.

3. A superconductive magnet according to claim 1, wherein said heat insulator is a cylindrical and sponge-like heat insulator.

4. A superconductive magnet according to claim 1, wherein said heat insulator is a cylindrical and sponge-like heat insulator having a cover on the outer surface thereof.

5. A superconductive magnet according to claim 1, wherein said heat insulator is disposed between said multi-stage regenerative refrigerator and said cylinder for fastening said refrigerator.

6. The magnet of claim 1 wherein the heat insulator is a plurality of hollow tubes spirally wound around the outer surface of the second cylinder.

7. The magnet of claim 1 wherein the heat insulator is a plurality of insulating members, each member having a semi-circular cross section and being spirally wound around the outer surface of the second cylinder.

8. An apparatus for connecting a refrigerator to a device, the refrigerator being of a type comprising a heat stage, a portion of which has refrigerating performance for reliquefying liquid helium, the apparatus comprising:

a cylinder for fastening the refrigerator to the device, the cylinder surrounding at least a portion of the refrigerator, the cylinder being at least partially surrounded by the device;

means for preventing heat convection of helium gas due to thermal gradient within the refrigerator and for preventing introduction of helium gas into an area between the refrigerator and the cylinder; and means, coupled to the cylinder and the scans for preventing heat convection, for preventing axial slip of the means for preventing heat convection with respect to the refrigerator.

9. The apparatus of claim 8, wherein the means for preventing includes a hollow teflon tube wound spirally around an outer surface of the refrigerator.

10. The apparatus of claim 8, wherein the means for preventing includes a teflon tube having a circular arc cross sectional shape wound spirally around an outer surface of the refrigerator.

11. The apparatus of claim 8, wherein the means for preventing includes a teflon ring having a circular arc cross sectional shape placed around an outer surface of the refrigerator.

12. The apparatus of claim 8, wherein the means for preventing includes means for providing a string-like convection member wound spirally around an outer surface of the refrigerator.

13. The apparatus of claim 8, wherein the means for preventing includes means a cylindrical and sponge-like heat insulator around an outer surface of the refrigerator.

14. The apparatus of claim 8, wherein the means for preventing includes a cylindrical and sponge-like heat insulator having a cover around an outer surface of the refrigerator.

15. The apparatus of claim 8, wherein the means for preventing includes a heat insulator formed by bagging granular heat insulating materials around an outer surface of the refrigerator.

* * * * *